US009557022B2

(12) United States Patent
Araki

(10) Patent No.: US 9,557,022 B2
(45) Date of Patent: Jan. 31, 2017

(54) NON-ROUND RETROFIT RECESSED LED LIGHTING FIXTURE

(71) Applicant: Ever Venture Solutions, Inc., Irvine, CA (US)

(72) Inventor: John Araki, Tustin, CA (US)

(73) Assignee: Ever Venture Solutions, Inc., Irvine, CA (US)

( * ) Notice: Subject to any disclaimer, the term of this patent is extended or adjusted under 35 U.S.C. 154(b) by 159 days.

(21) Appl. No.: 14/700,671

(22) Filed: Apr. 30, 2015

(65) Prior Publication Data

US 2016/0320007 A1 Nov. 3, 2016

(51) Int. Cl.

| | |
|---|---|
| ***F21S 8/02*** | (2006.01) |
| ***F21V 23/06*** | (2006.01) |
| ***F21V 19/02*** | (2006.01) |
| ***F21V 19/00*** | (2006.01) |
| ***F21V 23/02*** | (2006.01) |
| ***F21V 23/00*** | (2015.01) |

(52) U.S. Cl.

CPC ..... *F21S 8/026* (2013.01); *F21V 19/004* (2013.01); *F21V 19/02* (2013.01); *F21V 23/009* (2013.01); *F21V 23/023* (2013.01); *F21V 23/06* (2013.01)

(58) Field of Classification Search

CPC ..... F21S 8/026; F21V 19/02; F21V 19/004; F21V 23/009; F21V 23/06; F21V 23/023

See application file for complete search history.

(56) References Cited

U.S. PATENT DOCUMENTS

| | | | |
|---|---|---|---|
| 3,892,959 | A | 7/1975 | Pulles |
| 4,975,809 | A | 12/1990 | Ku |
| 5,027,258 | A | 6/1991 | Schoniger et al. |

(Continued)

FOREIGN PATENT DOCUMENTS

| | | | |
|---|---|---|---|
| CN | 201225561 | Y | 4/2009 |
| CN | 201513783 | U | 6/2010 |

(Continued)

OTHER PUBLICATIONS

International Preliminary Report on Patentability dated Oct. 20, 2015 corresponding to International Patent Application No. PCT/US2014/033352, 11 pages.

(Continued)

*Primary Examiner* — David V Bruce

(74) *Attorney, Agent, or Firm* — Arthur Moore; Dentons US LLP

(57) ABSTRACT

A light emitting diode (LED) light fixture for attachment to a recessed electrical connection enclosure includes a luminaire with a frame having a non-round form. The light fixture includes a luminaire rotatably joined to a mounting member at a rotary connector. The mounting member has least one fastener for attaching the mounting member to a mounting fixture of the recessed electrical connection enclosure. The luminaire may be rotated relative to the mounting member attached to the mounting fixture of the recessed electrical connection enclosure, to orient the non-round frame of the luminaire in a desired orientation. The mounting member may be a mounting bar, and may include first and second fasteners at opposite ends of the mounting bar. Various types of fasteners may be employed for attachment to the mounting fixture of the recessed electrical connection enclosure, such as torsion springs, tension clips, J-box bracket clips, and twist-and-lock fasteners.

20 Claims, 10 Drawing Sheets

(56) References Cited

U.S. PATENT DOCUMENTS

| | | | |
|---|---|---|---|
| 5,276,591 | A | 1/1994 | Hegarty |
| 5,375,043 | A | 12/1994 | Tokunaga |
| 5,636,462 | A | 6/1997 | Kleiman |
| 5,641,219 | A | 6/1997 | Mizobe |
| 5,806,972 | A | 9/1998 | Kaiser et al. |
| 6,042,243 | A | 3/2000 | Grill et al. |
| 6,095,660 | A | 8/2000 | Moriyama |
| 6,231,213 | B1 | 5/2001 | Schmidt et al. |
| 6,641,283 | B1 | 11/2003 | Bohler |
| 6,739,734 | B1 | 5/2004 | Hulgan |
| 6,758,573 | B1 | 7/2004 | Thomas |
| 6,840,646 | B2 | 1/2005 | Cornelissen et al. |
| 6,880,963 | B2 | 4/2005 | Luig |
| 6,997,576 | B1 | 2/2006 | Lodhie |
| 7,015,987 | B2 | 3/2006 | Wu et al. |
| 7,090,387 | B2 | 8/2006 | Kohno |
| 7,172,324 | B2 | 2/2007 | Wu |
| 7,201,488 | B2 | 4/2007 | Sakamoto et al. |
| 7,236,155 | B2 | 6/2007 | Han et al. |
| 7,374,327 | B2 | 5/2008 | Schexnaider |
| 7,445,369 | B2 | 11/2008 | Yu |
| 7,448,768 | B2 | 11/2008 | Sloan et al. |
| 7,473,022 | B2 | 1/2009 | Yoo |
| 7,547,112 | B2 | 6/2009 | Kim |
| 7,563,015 | B2 | 7/2009 | Tzung-Shiun |
| 7,570,313 | B2 | 8/2009 | Wu |
| 7,583,901 | B2 | 9/2009 | Nakagawa |
| 7,604,389 | B2 | 10/2009 | Sakai |
| 7,708,447 | B2 | 5/2010 | Tobler et al. |
| 7,722,221 | B2 | 5/2010 | Chae |
| 7,726,617 | B2 | 6/2010 | Zambelli |
| 7,766,536 | B2 | 8/2010 | Peifer |
| 7,787,070 | B2 | 8/2010 | Choi et al. |
| 7,825,892 | B2 | 11/2010 | Lin et al. |
| 7,894,013 | B2 | 2/2011 | Chung et al. |
| 7,918,598 | B2 | 4/2011 | Peifer et al. |
| 8,029,293 | B2 | 10/2011 | Janos et al. |
| 8,061,867 | B2 | 11/2011 | Kim |
| D653,376 | S | 1/2012 | Kong |
| 8,092,034 | B2 | 1/2012 | Zarian et al. |
| 8,092,069 | B2 | 1/2012 | Chuang et al. |
| 8,096,671 | B1 | 1/2012 | Cronk |
| 8,136,958 | B2 | 3/2012 | Verfuerth et al. |
| 8,167,627 | B1 | 5/2012 | Janos |
| 8,915,636 | B2 | 12/2014 | Araki et al. |
| 9,062,867 | B2 | 6/2015 | Rodgers et al. |
| 9,068,704 | B2 | 6/2015 | Burton et al. |
| 9,206,964 | B2 | 12/2015 | Marsh et al. |
| 2004/0240230 | A1 | 12/2004 | Kitajima |
| 2005/0082453 | A1 | 4/2005 | Chuang |
| 2005/0174755 | A1 | 8/2005 | Becker |
| 2005/0180172 | A1 | 8/2005 | Jang |
| 2005/0219860 | A1 | 10/2005 | Schexnaider |
| 2006/0022214 | A1 | 2/2006 | Morgan |
| 2006/0158906 | A1 | 7/2006 | Parker |
| 2006/0291238 | A1 | 12/2006 | Epstein |
| 2006/0291241 | A1 | 12/2006 | Wojtowicz et al. |
| 2007/0000849 | A1 | 1/2007 | Lutz et al. |
| 2007/0047262 | A1 | 3/2007 | Schardt |
| 2007/0076431 | A1 | 4/2007 | Atarashi et al. |
| 2007/0097227 | A1 | 5/2007 | Toyokawa |
| 2007/0115402 | A1 | 5/2007 | Zhang et al. |
| 2007/0165424 | A1 | 7/2007 | Sakai |
| 2007/0171670 | A1 | 7/2007 | Zagar |
| 2007/0222914 | A1 | 9/2007 | Kotchick et al. |
| 2007/0247414 | A1 | 10/2007 | Roberts |
| 2007/0247842 | A1 | 10/2007 | Zampini |
| 2007/0247870 | A1 | 10/2007 | Sakai et al. |
| 2008/0013303 | A1 | 1/2008 | Guarino |
| 2008/0101094 | A1 | 5/2008 | Spada et al. |
| 2008/0231196 | A1 | 9/2008 | Weng et al. |
| 2008/0297679 | A1 | 12/2008 | Jung et al. |
| 2009/0097277 | A1 | 4/2009 | Iwasaki |
| 2009/0135608 | A1* | 5/2009 | Sell ..... F21S 8/026 362/365 |
| 2009/0147507 | A1 | 6/2009 | Verfuerth et al. |
| 2009/0213589 | A1 | 8/2009 | Peifer et al. |
| 2009/0316396 | A1 | 12/2009 | Tsai |
| 2009/0323334 | A1 | 12/2009 | Roberts et al. |
| 2010/0061108 | A1* | 3/2010 | Zhang ..... F21V 29/004 362/364 |
| 2010/0124064 | A1 | 5/2010 | Ogawa et al. |
| 2010/0165241 | A1 | 7/2010 | Kim et al. |
| 2010/0171145 | A1 | 7/2010 | Morgan |
| 2010/0172138 | A1 | 7/2010 | Richardson |
| 2010/0176742 | A1 | 7/2010 | Hwan |
| 2010/0237798 | A1 | 9/2010 | Wolf |
| 2010/0284185 | A1 | 11/2010 | Ngai |
| 2010/0289428 | A1 | 11/2010 | Frazier |
| 2010/0315833 | A1 | 12/2010 | Holman et al. |
| 2011/0068708 | A1 | 3/2011 | Coplin |
| 2011/0075414 | A1 | 3/2011 | Van De Ven et al. |
| 2011/0149596 | A1 | 6/2011 | Lv et al. |
| 2011/0279063 | A1 | 11/2011 | Wang et al. |
| 2011/0291569 | A1 | 12/2011 | Shin |
| 2012/0020109 | A1 | 1/2012 | Kim et al. |
| 2012/0081889 | A1 | 4/2012 | Frost et al. |
| 2012/0091919 | A1 | 4/2012 | Tveit |
| 2012/0106177 | A1 | 5/2012 | Blankestijn et al. |
| 2012/0182733 | A1 | 7/2012 | Cho |
| 2012/0218746 | A1 | 8/2012 | Winton |
| 2012/0287631 | A1 | 11/2012 | Sheng |
| 2012/0320627 | A1 | 12/2012 | Araki et al. |
| 2012/0328242 | A1 | 12/2012 | Hesse |
| 2013/0038211 | A1 | 2/2013 | Kang |
| 2013/0044512 | A1 | 2/2013 | Araki et al. |
| 2013/0070455 | A1 | 3/2013 | Tsui et al. |
| 2013/0258706 | A1 | 10/2013 | Urtiga et al. |
| 2014/0240966 | A1 | 8/2014 | Garcia et al. |
| 2014/0313780 | A1 | 10/2014 | Myers |
| 2014/0376266 | A1 | 12/2014 | Myers et al. |
| 2015/0049512 | A1 | 2/2015 | Myers et al. |

FOREIGN PATENT DOCUMENTS

| | | | |
|---|---|---|---|
| CN | 201628158 | | 11/2010 |
| CN | 201724032 | U | 1/2011 |
| DE | 202009007334 | U1 | 9/2009 |
| DE | 102010006465 | A1 | 8/2011 |
| DE | 102010008359 | A1 | 8/2011 |
| DE | 202012103430 | U1 | 9/2012 |
| EP | 1059484 | A1 | 12/2000 |
| EP | 1906081 | A1 | 4/2008 |
| EP | 2088835 | A1 | 8/2009 |
| EP | 2131100 | A1 | 12/2009 |
| EP | 1361391 | A2 | 4/2010 |
| EP | 2270387 | B1 | 9/2011 |
| EP | 2495490 | A2 | 9/2012 |
| JP | 2004271734 | A | 9/2004 |
| JP | 2004335426 | A | 11/2004 |
| JP | 2006106212 | A | 4/2006 |
| JP | 3140783 | U | 4/2008 |
| JP | 2011-138731 | A | 7/2011 |
| WO | 2009017117 | A1 | 2/2009 |
| WO | 2010133535 | A1 | 11/2010 |
| WO | 2012/113005 | A1 | 8/2012 |
| WO | 2012125605 | A3 | 9/2012 |
| WO | 2012158894 | | 11/2012 |
| WO | 2012158908 | | 11/2012 |

OTHER PUBLICATIONS

International Preliminary Report on Patentability dated Oct. 20, 2015 corresponding to International Patent Application No. PCT/US2014/033953, 8 pages.

Communication and Annex from the Examining Division dated Sep. 17, 2015 corresponding to European Patent Application No. 12 726 949.6, 5 pages.

Non-Final Office Action issued in U.S. Appl. No. 13/473,918 dated Jan. 6, 2014, 19 pages.

Final Office Action issued in U.S. Appl. No. 13/473,918 dated Jun. 4, 2014, 16 pages.

(56) References Cited

OTHER PUBLICATIONS

Notice of Allowance issued in U.S. Appl. No. 13/473,918 dated Aug. 11, 2014.
Applicant Initiated Interview Summary dated Jun. 16, 2016 corresponding to U.S. Appl. No. 14/480,262, 4 pages.
Notice of Allowance dated Jul. 29, 2016 corresponding to U.S. Appl. No. 14/480,262, 17 pages.
Non-Final Office Action dated Apr. 24, 2015 corresponding to U.S. Appl. No. 14/554,919, 18 pages.
Final Office Action dated Oct. 7, 2015 corresponding to U.S. Appl. No. 14/554,919, 36 pages.
Applicant Initiated Interview Summary Jul. 8, 2016 corresponding to U.S. Appl. No. 14/246,823, 3 pages.
Non-Final Office Action dated Sep. 1, 2015 corresponding to U.S. Appl. No. 14/254,822, 8 pages.
Non-Final Office Action dated Mar. 30, 2015 corresponding to U.S. Appl. No. 14/618,665, 9 pages.
Non-Final Office Action dated Sep. 15, 2015 corresponding to U.S. Appl. No. 14/618,665, 17 pages.
Final Office Action dated Jul. 14, 2016 corresponding to U.S. Appl. No. 14/480,772, 17 pages.
Non-Final Office Action/Requirement for Restriction/Election issued in U.S. Appl. No. 13/483,918 dated Nov. 14, 2012, 6 pages.
Non-Final Office Action issued in U.S. Appl. No. 13/483,918 dated Apr. 23, 2013, 9 pages.
Notice of Allowance issued in U.S. Appl. No. 13/483,918 dated Nov. 22, 2013, 9 pages.
Non-Final Office Action issued in U.S. Appl. No. 13/473,929 dated Apr. 10, 2015, 26 pages.
Final Office Action issued in U.S. Appl. No. 13/473,929 dated Oct. 22, 2015, 33 pages.
"Lamp Size and Comparison Features." Retrieved on Nov. 9, 2015, from http://www.grainger.com/tps/lighting_lamp_size_and_feature_comparison_pdf, 1 page.
Wilson, R., "Power Integrations LED driver is 88% efficient for 100W bulb replacement," ElectronicsWeekly.com, Sep. 2015, retrieved from the Internet: http://www.electronicsweekly.com/blost/led-luminaries/power-integrations-led-driver-is-889-efficient-for_100w-bulb-replacement-2012-09/, retrieved on Dec. 7, 2015, 3 pages.
Think Lumens, Not Watts: Buying Light bulbs in the 21st Century, EarthLED, retrieved from the Internet: https://www.earthled.com/pages/lumens-watts-and-buying-lightbulbs-in-the-21st-century, retrieved on Dec. 7, 2015, 5 pages.
Lumination LED Luminaires—Recessed LED Troffer—ET Series, GE imagination at work, retrieved from the Internet: www.gelighting.com/LightingWeb/na/solutions/indorr-lighting/recessed/lumination-et-series.jsp, retrieved on Dec. 7, 2015, 8 pages.
Google Translation of CN 201628158—downloaded from www.google.com/patents on Sep. 22, 2015; 3 pages.
LEDsupply, "Understanding LED Drivers and How to Choose the Right One," undated, downloaded from http://www.ledsupply.com/blog/understanding-led-drivers/ on Jun. 12, 2015, 5 pages.
Notice of Allowance issued in U.S. Appl. No. 14/497,943 dated Jun. 22, 2016, 13 pages.
Non Final Office Action in U.S. Appl. No. 14/497,943 dated Mar. 27, 2015, 9 pages.
Non Final Office Action in U.S. Appl. No. 14/497,943 dated Aug. 28, 2015, 14 pages.
Final Office Action in U.S. Appl. No. 14/497,943 dated Jun. 24, 2015, 8 pages.
Examiner's Amendment and List of References cited by applicant and considered by examiner in U.S. Appl. No. 14/497,943 dated Jul. 20, 2016, 3 pages.
Power integrations DER-323 18 W A19 LED Driver Using LNK460VG, Figure 1 and figure 2, p. 4 http://www.power.com/sites/default/files/PDFFiles/der323.pdf Jun. 21, 2012, 39 pages.
Non-Final Office Action dated May 26, 2016 corresponding to U.S. Appl. No. 14/517,676, 11 pages.
Notice of Allowance issued in U.S. Appl. No. 15/092,186 dated Jul. 18, 2016, 9 pages.
Notice of Allowance issued in U.S. Appl. No. 15/158,353 dated Jul. 5, 2016, 10 pages.
Applicant Initiated Interview Summary dated Aug. 18, 2016 corresponding to U.S. Appl. No. 14/517,676, 9 pages.
Shenzhen Bonld Electronics Co., LTD., Quotation of DLC LED Panel, New Price List of DLC Panel-Bonld, received from the vendor on Nov. 17, 2015, 1 page.
Shenzhen Huadian Lighting Co., Ltd, "Top 2 Bestseller of LED Panel Light in China", downloaded from http://www.hd-leds.com/products.php. On Aug. 17, 2016; similar brochure distributed during Hong Kong International Lighting Fair, Autumn Edition, Oct. 27-30, 2015, 4 pages.
Syhdee, "LED Panel Light", Product Specification of Flat Panel of Shenzhen Syhdee Co., Ltd., product specification was received by email from Shenzhen Syhdee Co., Ltd. on Aug. 3, 2016.
ATG Electronics Corp., "iBright Flat LED Panel", website description, undated; downloaded from http://www.atgelectroni cs.com/lighting/Illumination/LEDTroffer/Flat-LED-Panel.html on Apr. 25, 2013; 9 pages.
Delta Electronics, "General Lighting: LED Lighting Solutions", product brochure, undated; downloaded from http://www.delta.com.tw/product/rd/led/products/luminaire/lum_fl01.asp on Mar. 30, 2012; 2 pages.
Dongbu Lightec, "LED Light Panel Installation Guide", undated; downloaded from http://www.dongbulightec.ca/English/Products/LED_L_P_Tech.html on Mar. 30, 2012; 5 pages.
Dongbu Lightec, "LumiSheet Lamp", pamphlet from LIGHTFAIR International (LFI) on Apr. 23-25, 2013; 9 pages.
ELumination, "Custom LED Light Panels", undated; downloaded from www.elumanation.com on Dec. 4, 2012; 1 page.
Energetic Lighting, "LED Panel Light", product features for ELEP2x250 and ELEP2x450, undated; downloaded from www.energeticlighting.com on Mar. 30, 2012; 1 page.
Enlight Corporation, "Ultraslim LED Panel Light", website description, undated; downloaded from http://twe.enlightcorp.com/ on Apr. 25, 2013; 2 pages.
Foshan Sunbay Opto Electronics Co., Ltd., "Super Thin and Driver Inside 300*300 22W LED Panel Light", undated; originally downloaded from http://sunbayled.en.made-in-china.com/product/vBxnWSXobmhY/China-Super-Thin-and-Driver-Inside-300-300-22W-LED-Panel-Light.html on Apr. 20, 2013; 3 pages.
GE Lighting Solutions, "GE Lighting Flat LED Panel", undated; downloaded on Jan. 16, 2012; 10 pages.
GE Lighting Solutions, "Lumination LED Luminaires—Troffer", undated; downloaded from http:/www.gelightingsolutions.com/Indoor/id-456789e/Lumination_LED_Luminaires_-_Troffer on Jul. 12, 2012; 2 pages.
GE Lighting Solutions, specification sheet for the 2×2 Edgelighting Fixture for troffer fixtures, pamphlet from LIGHTFAIR International (LFI) on May 17-19, 2011; 1 page.
General Lighting Electronic Co., LTD, LED Panel Light specifications for 60w 600×600, undated; originally downloaded from http://www.g1-leds.com/led-news/led-panel-1ight-60w-600×600-01.html on Jun. 6, 2011; 3 pages.
General Lighting Electronic Co., "LED Light Panel List", undated; originally downloaded from http://www.gl-leds.com/led-panel-light-list.html on Apr. 23, 2013; 2 pages.
Global Lighting Technologies Inc., "LED Edge Lighting", pamphlet from LIGHTFAIR International (LFI) on Apr. 23-25, 2013; 12 pages.
Green Led Lighting Solutions Inc., "LED Light Panel: Ultra Thin LED Light Box (Built in Power Supply)", product brochure, undated; downloaded from www.ledlightpanel.com on Apr. 23, 2013; 1 page.
Intematix Corporation, "Customer Case Study—Tech Lighting Unilume: Innovation for Undercabinet Lighting", brochure of Intematix for its Intematix Chromalit™ remote phosphor LEDs technology, undated; downloaded from www.intematix.com on Mar. 19, 3013; 2 pages.

(56) References Cited

OTHER PUBLICATIONS

Luminousfilm.com, a Knema, LLC company, "LED Light Panels Information", website description, undated; originally downloaded from http://www.luminousfilm.com/led.htm on Mar. 19, 2013; 5 pages.
Maxim Lighting; website description of LED flat lights, undated; originally downloaded from http://www.maximlighting.com/ on Mar. 19, 2013; 2 pages.
Maxim Lighting, "CounterMax StarStrand Counter, Accent & Task Lighting Solutions", copyright 2012; originally downloaded from http://www.maximlighting.com/catalog_pdf.aspx?c:brochure &n=LMXBR01203.pdf on Mar. 19, 2013; pp. 1-5, 11-14; 10 pages.
MAXLITE, specification sheet for 2×4 flat light, pamphlet from LIGHTFAIR International (LFI) on May 17-19, 2011 ; 1 page.
MAXLITE, advertisement for maxLED Flat Panel 2×2, 2×4, and 1×4 models, for LIGHTFAIR International (LFI) on May 17-19, 2011; 5 pages.
Modular International Inc., "LED Panels", product brochure, undated; downloaded from http://www.modularinternational.com/literature.php on Mar. 6, 2009; 2 pages.
National Specialty Lighting, "LED Task Star", product brochure, undated; downloaded from http://www.nslusa.com/ on Mar. 19, 2013; 1 page.
Nicor Lighting, "T2LED 2×2 Troffer", product brochure, undated; downloaded from nicorlighting.com/uploads/.../t2-led-2×2-troffer-lumen-mainenance.pdf on Apr. 25, 2013; 1 page.
Nicor Lighting, "2013 Catalog Multifamily, Assisted Living, & Hospitality Lighting Products", copyright 2013, pamphlet from LIGHTFAIR International (LFI) on Apr. 23-25, 2013; pp. 1-4, 31; 7 pages.
Noke LED Lighting Technology Co., Ltd., "Ceiling Light 650×650mm", website description, undated; originally downloaded from http://www.nokeled.com/products/Ceiling-light-650×650mm.html on Jun. 11, 2012; 2 pages.
Patent Cooperation Treaty, "Invitation to Pay Additional Fees and, Where Applicable, Protest Fee", partial international search report for international application No. PCT/US2012/038338, mailed Sep. 19, 2012; 7 pages.
Patent Cooperation Treaty, "International Search Report", international search report for international application No. PCT/US2012/038338, Feb. 18, 2013; 7 pages.
Patent Cooperation Treaty, "Invitation to Pay Additional Fees and, Where Applicable, Protest Fee", partial international search report for international application No. PCT/US2012/038315, mailed Sep. 19, 2012; 9 pages.
Patent Cooperation Treaty, "International Search Report", international search report for international application No. PCT/US2012/038315, Feb. 13, 2013; 9 pages.
Rambus, "LED Light Bulbs", website description, Jan. 17, 2013; originally downloaded from http://www.rambus.com/us/technology/solutions/led-light-bulb/index.html?utm_source=Rambus+Contacts&utm_campaign=99dc5a0773-Technology_Bulb_Imerz_Launch1_17_2013&utm_medium=email on Feb. 12, 2013; 2 pages.
Shenzhen Borsche Electronic Co., Ltd., "LED Panel Light", product catalog, undated; originally downloaded from http://cnhidee.en.made-in-china.com/product-group/pqeQkYCcXtVK/LED-Panel-Light-catalog-1.html on Apr. 30, 2013; 3 pages.
Stellaray Technology Limited, "Flat LED Panel", published Mar. 19, 2012; downloaded from http://www.srleds.com/e/products/LED_Panel_Lights/led_panel_lights.html on Apr. 12, 2012; 26 pages.
Taiwan T-LUX Technology Co., Ltd, "BTHx Series Specification Sheet", Issued Oct. 12, 2010 and Modified Mar. 1, 2011; downloaded from http://www.t-lux.com.tw on Nov. 2, 2011; 7 pages.
Tech Lighting, a Generation Brands Company, "Unilume LED Undercabinet", product brochure and installation instructions, undated; downloaded on www.techlighting.com on Mar. 19, 2013; 6 pages.
Unity Opto Technology Co., Ltd., "Product Specification: UNi Ceiling Lighting_12020", Jan. 7, 2011; downloaded from http://www.unityopto.com.tw/ on Mar. 19, 2013; 5 pages.
Unity Opto Technology Co., Ltd., "Product Specification: Ceiling Lighting_6060", Nov. 24, 2010; downloaded from http://www.unityopto.com.tw/ on Mar. 19, 2013; 4 pages.
Zenaro' "Axenia-Modul 600 40W", website description, undated; downloaded from http://europe.zenaro-led.com/en/products/europe/office-lights/itemlist/category/82-axenia on Jun. 22, 2012; 1 page.
BANQ Technology Co., Ltd., "300*300 Second Generation LED Panel Light," website description, copyright 2013; downloaded from http://www.banqcn.com/product-141.html on Oct. 28, 2013; email received from website owner on Oct. 9, 2013; 6 pages.
BBF Hitech Intl Co., Ltd, "300×300×11mm," website description, copyright 2010; downloaded from http://www.bbfled.com/productshow_386.html on Oct. 28, 2013; email received from website owner on Sep. 7, 2013; 2 pages.
Bravoled Lighting Manufacturing Co., Limited, "Bravoled, BL-P6-10W ANS," website description, copyright 2010; downloaded from http://www.bravoled.com/html/prs0/t287-310/c565.html on Oct. 28, 2013; email received from website owner on Sep. 26, 2013; 2 pages.
Chinese CleanTech Components Company Ltd, CCTCC, "CTC-300/1200W," website description, undated; downloaded from http://www.cctcc-group.com/productShow.asp?PicID=967 on Oct. 28, 2013; email received from website owner on Sep. 11, 2013; 2 pages.
Ecolux Doubletree, "LED Integrate Super Flatlight," website description, copyright 2003; downloaded from www.ecolux.com.cn/aspcms/product/2013-4-20/292.html on Aug. 30, 2013; 2 pages.
General Electric Company, "GE Lighting E-Catalogue," product brochure, copyright 1997-2013; downloaded from http://catalog.gelighting.com/system/indoor-luminaires/recessed/lumination/?r:emea on Oct. 30, 2013; 4 pages.
General Electric Company, "Infusion LED Modules System," website description, copyright 1997-2013; downloaded from http://www.gelighting.com/LightingWeb/emea/products/highlights/infusion-led-module/overview/#3 on Aug. 8, 2013; 1 page.
Heeber Lighting Co., Ltd., "Heeber 600×600mm, 26w LED panel_Heeber," website description, copyright 2005; downloaded from http://www.heeber.com/cp/html/?5.html on Oct. 28, 2013; email received from website owner on Oct. 8, 2013; 3 pages.
Hilton Electrical Co., Ltd., "Hilton LED Products 2013 List," copyright 2009; Product list received by email from website owner on Aug. 13, 2013; 45 pages.
HK Raymates Electronic Co., Ltd, "RM-COB15/30W-W," website description, undated; downloaded from http://www.raymates.com/index.php/product/view/649.html on Oct. 28, 2013; email received from website owner on Sep. 11, 2013; 1 page.
Keyuan Optoelectronic Co., Ltd, "Your Present Position: Display, KYZM12060," website description, undated; downloaded from http://www.zs-keyuan.com/en/displayproduct.html?proID=3068225 on Oct. 28, 2013; email received from website owner on Sep. 2, 2013; 2 pages.
Kindom Opto-Electronic Co., Ltd., "300*300 LED Panel Light (side shine)," website description, copyright 2002-2009; downloaded from http://www.kindomled.com/eng/productsview.asp?id=205 on Oct. 28, 2013; email received from website owner on Sep. 9, 2013; 2 pages.
Lamptop Optoelectronics Tech Co., Ltd. "LED Panel Light-LampTop Optoelectronics Technology Co., LTD," website description, copyright 2009-2013; downloaded from http://www.lamptopled.com/Product/5928161511.html on Sep. 25, 2013; email received from website owner on Sep. 5, 2013; 2 pages.
NGE Technology Limited, "Products Introduction: 300*300mm LED panel light," website description, copyright 2011; downloaded from http://www.nge-led.com/products/NGE-P0303-S18W/ on Oct. 28, 2013; email received from website owner on Sep. 17, 2013; 2 pages.
Ningbo KingsLED Electronics CO., LTD, "LED ultrathin downlight & LED panel lighting," website description, undated; brochure and email from website owner sent on Jul. 30, 2013; 4 pages.

(56) References Cited

OTHER PUBLICATIONS

Ningbo Yoogir Energy Saving Technology Co., Ltd, "LED PL Lamp, LED PLAC, LED Plug Light, LED PL Light, LED Panel Light, LED Tube," website description, copyright 2003-2013; downloaded from http://www.yoogir.com/HK-PL6060.html on Oct. 24, 2013; email received from website owner on Oct. 17, 2013; 2 pages.
Senseled Technology Co., Limited, "RGB Wall & Ceiling & Dance Floor Pannel," website description, undated; downloaded from http://www.senseled.com/product-detail.asp?Product_lld=138& Big_Class_id=93; downloaded from website owner on Oct. 29, 2013; email received from website owner on Oct. 10, 2013; 1 page.
Shanghai Goodsun Lighting Co. Ltd, "A. Ultrathin LED Panel Light 600mm*600mm," website description, copyright 2011-2012; downloaded from http://www.shgoodsun.com/led-panel-light-600-600.html on Oct. 24, 2013; email received from website owner on Oct. 18, 2013; 3 pages.
Shenzhen Aoser Lighting, "SMD2835 led panel light," website description, copyright 2010; downloaded from http://www.aoserled.com/en/Products_detail.asp?I D=326 on Oct. 28, 2013; email received from website owner on Aug. 2, 2013; 2 pages.
Shenzhen BANQ Technology Co., "600*600 front lighting led panel light_Shenzhen Banq Technology Co., LTD," website description, copyright 2013; downloaded from http://www.banqcn.com/product-139.html on Oct. 28, 2013; email received from website owner on Aug. 5, 2013; 6 pages.
Shenzhen Boyao Optoelectronic Technology Co., Ltd, "Shenzhen Boyao Optoelectronic Technology Co., Ltd.—LED High Bay Light, LED Panel Light," website description, copyright 1999-2013, downloaded from boyao-tech.en.alibaba.com on Sep. 9, 2013; email received from website owner on Aug. 29, 2013; 3 pages.
Shenzhen Huadian Lighting Co., Ltd, "Professional Manufacturer of LED Tube, LED Panel Light, LED Down Lights, LED Spotlight, etc.," website description, undated; downloaded from http://www.hd-leds.com/products-detail.php?Prol d=81 on Oct. 28, 2013; email received from website owner on Sep. 2, 2013; 2 pages.
Shenzhen Loevet Lighting Co. Ltd, "Wholesale 600*600mm LED Panel Light Series from Loevet Lighting Co., LTD in China," website description, copyright 2008-2013; downloaded from http://www.lvt-lighting.com/led-panel-light-36W-600×600mm.html on Oct. 28, 2013; email received from website owner on Sep. 6, 2013; 3 pages.
Shenzhen Wak Optoelectronic Co., Ltd, "High Brightness LED Panel Light 600×600mm," website description, undated; downloaded from http://www.wak-led.com/product/showproduct.php?lang=en&id=111 on Oct. 28, 2013; email received from website owner on Aug. 25, 2013; 2 pages.
Tsanli Lighting Co., Limited, "LED Panels—LED Light Panel_LED Panels—LED Light Panel Manufacturers & Suppliers," website description, copyright 2013; downloaded from http://www.sanli-led.com/LED_panel.aspx on Oct. 28, 2013; email received from website owner on Oct. 14, 2013; 8 pages.
Up-shine Lighting Co., Limited, "LED Panel Lamp, Dimmable LED Light, High Lumen LED Lamp, Up-Shine Lighting," website description, undated; downloaded from http://www.upshineled.com/5-led-panel-lamp.html on Oct. 24, 2013; email received from website owner on Oct. 14, 2013; 4 pages.
Westpac LED Lighting, Inc., "LED Panel Lights," website description, copyright 2013; downloaded from http://www.westpacled.com/products/led-panel-lights/ on Oct. 30, 2013; 1 page.
Newsen Electronics Technology Limited, "Newsen Technology, LED Manufacturer, LED Commercial Light, LED Home Light, LED Project Light," website description, copyright 2004-2009; downloaded from http://www.newsenlighting.com/productView.asp?Id=162 on Nov. 4, 2013; email received from website owner on Oct. 29, 2013; 3 pages.
Google Translation of DE 202012103430 U1—downloaded from www.google.com/patents on Oct. 18, 2014; 10 pages.
Google Translation of DE 102010006465A1—downloaded from www.google.com/patents on Nov. 1, 2013; 4 pages.
Google Translation of EP 2270387 B1—downloaded from www.google.com/patents on Nov. 5, 2013; 7 pages.
Alite Co., Ltd., "Products/DLC qualified LED panel_Alite co., Ltd-Led tube lighting, Led bulb, Led spotlights lights, Led panel-china Led Lighting, China Led manufacturer," website description, copyright 2008-2013; downloaded from http://www.aliteled.com/a/Prouducts/dlcledpanel/ on Jan. 2, 2014; 2 pages.
Asia-Boslin Optoelectronics Sci & Tech Group Co., LTD, "600×600mm 40W 5630 Samsung Ultra-Thin LED Panel Light," website description, copyright 2014; downloaded from www.simaoled.com/english/pro_show.asp?mid=2&name=40W%20LED%20Panel%20Light&pc1_id=13&p_id=741&p_name=40W%20LED%20Panel %20Light#123 on Apr. 15, 2014; email received from website owner on Mar. 10, 2014; 7 pages.
Ecother Technology Limited, "LED Panel Light ET-PL-S6060-36W," website description, copyright 2007-2012; downloaded from http://ecother.com/showproducts.php?id=41 on Apr. 1, 2014; 2 pages.
Emerge DDP Engineered LED Solutions, "Products|Emerge," website description, copyright 2014; downloaded from www.emergelighting. com/products/ on Feb. 19, 2014; 1 page.
HK Kstar Electronic Co., Ltd. "RGB 600*600 LED Panel Light," website description, undated; downloaded from http://www.kstar-lighting.com/product.asp?id=1675 on Jan. 2, 2014; email received from website owner on Sep. 25, 2013; 3 pages.
International Application No. PCT/US12/38315 International Preliminary Report on Patentability and Written Opinion of the International Searching Authority Dated November 19, 2013 Attached to International Publication No. WO 2012/158894—Nov. 22, 2012.; 12 Pages.
International Application No. PCT/US12/38338 International Preliminary Report on Patentability and Written Opinion of the International Searching Authority Dated Nov. 19, 2013 Attached to International Publication No. WO 2012/15S90S—Nov. 22, 2012.; 11 Pages.
Kili-LED Lighting Limited, "LED Panel Light," website description, undated; downloaded from http://www.kili-led.com/?producten/Product57/ on Apr. 1, 2014; email received from website owner on Mar. 24, 2014; 3 pages.
Light Green International Co., Ltd., "Light Green International Co., Ltdl The Largest Manufacturer of LED Panel Lights in China," website description, copyright 2010-2012; downloaded from http://light-green.cn/english/Product_Catalog_03_01.aspx?id=65 on Apr. 16, 2014; email received from website owner on Apr. 2, 2014; 2 pages.
OPUS Technology Development Co., Ltd., "600×1200mm LED Panel Light SOW," website description, undated; downloaded from http://www.opus-led.com/600×1200mm-LED-Panel-Light-SOW.html on Mar. 12, 2014; email received from website owner on Mar. 10, 2014; 3 pages.
QuarkStar, "Light Shaping: An Innovative New Approach for SSL Luminaires," presentation from Strategies in Light conference on 2/25/27/2014, undated; 32 pages.
Shenzhen CREP Optoelectronics Co., Ltd., "CREP Optoelectronic Co., Ltd.," website description, copyright 2010-2011; downloaded from http://www.crep-led.com/EN/products.aspx on Nov. 16, 2013; email received from website owner on Nov. 13, 2013; 2 pages.
Shenzhen King Star Opto-Electronic Co., LTD, "China Ultra-thin Economical LED Panel Light supplier," website description, copyright 2005-2013; downloaded from http://www.ks-light.com/china-id293.html on Apr. 16, 2014; email received from website owner on Apr. 1, 2014; 5 pages.
Shenzhen Magreen Group Co., Ltd., "Shenzhen Magreen Lighting Technology Co., Limited," email attachment received by website owner on Apr. 1, 2014; undated; 3 pages.
Shenzhen Man Jia Technology Limited, "1Sw square led panel light with glass edge," website description, copyright 2011-2012; downloaded from http://www.manjia-lighting.com/detail/1Swsquareledpanellightwithgl assedge.html### on Nov. 16, 2013; email received from website owner on Nov. 16, 2013; 7 pages.
Shenzhen Ming Light Co., Ltd, "Minglight Manufacturing Co; Ltd>>LED Panel Light>>LED Panel Light 600×600 1S&20&39W,

(56) References Cited

OTHER PUBLICATIONS

IP54," website description, copyright 2011; downloaded from http://www.minglight.com.cn/LED%20Panel%20Light%20600x600%20%201S&20&39W,%201P54-pii-4S.html on Nov. 16, 2013; email received from website owner on Nov. 14, 2013; 4 pages.
Shenzhen MJ International, "Energy Light Index," website description, undated; downloaded from http://www.energyledlight.com/eindex.asp on Apr. 15, 2014; email received from website owner on Feb. 17, 2014; 1 page.
Shenzhen Ruidisi Lighting Co., Ltd, "RDS-6060-Ruidisi Lighting (HK) Co., Limited," website description, copyright 2013; downloaded from http://www.rds-led.com/Products/Candle_Light_Series/Square_panel_light/rds11.html on Nov. 16, 2013; email received from website owner on Nov. 16, 2013; 2 pages.
Shine Technology Ltd, "Led light-led panel light, led bulb and waterproof led power supply manufacturer in China," website description, copyright 1999-2013, downloaded from http://shine-technology.en.alibaba.com on Dec. 23, 2013; email received from website owner on Nov. 25, 2013; 3 pages.
Star Light Technology Group (China) Limited, "LED Panel light 1200*600 (Full color)—LED Panel Light—China—Star," website description, copyright 1995-2013; downloaded from www.starlight-led.com/sdp/865240/4/pd-4460524/6793633-1955803/LED_Panel_light_600_600_Full_colors.html#normal_i mg on Dec. 23, 2013; 2 pages.
Tonya Lighting Technology Co., Ltd., "Tonya Lighting Technology Co., Ltd," website description, copyright 2009; downloaded from http://www.tonyalight.com/Default.aspx?PN:prd_view&ps:&pID=75466 on Nov. 15, 2013; email received from website owner on Nov. 15, 2013; 2 pages.
West Deer Technology Co., Limited, "Product Show," website description, copyright 2013; downloaded from http://wdeer-led.com/html/prs0/t287-310/c556.html on Apr. 15, 2014; email received from website owner on Mar. 3, 2014; 2 pages.
Patent Cooperation Treaty, "Invitation to Pay Additional Fees and, Where Applicable, Protest Fee", partial international search report for international application No. PCT/US2014/033352, mailed Aug. 11, 2014; 6 pages.
Google Translation of DE 102010008359 A1—downloaded from www.google.com/patents on Oct. 17, 2013; 16 pages.
Google Translation of EP 1361391 A2—downloaded from www.google.com/patents on Oct. 17, 2013; 6 pages.
Google Translation of EP 1059484 A1—downloaded from www.google.com/patents on Oct. 17, 2013; 17 pages.
Patent Cooperation Treaty, "Notification of Transmittal of International Search Report and the Written Opinion of the International Searching Authority", international search report for international application No. PCT/US2014/033953, mailed Aug. 13, 2014; 12 pages.
Thomson Scientific translation of WO 2009017117 A1—enclosed with international search report for international application No. PCT/US2014/033953, mailed Aug. 13, 2014; 24 pages.
Google Translation of WO 2012/113005 A1—downloaded from www.google.com/patents on Oct. 17, 2013; 5 pages.
Patent Cooperation Treaty, "International Preliminary Report on Patentability", written opinion of the international searching authority for international application No. PCT/US2012/038315, mailed Nov. 19, 2013; 12 pages.
Patent Cooperation Treaty, "International Preliminary Report on Patentability", written opinion of the international searching authority for international application No. PCT/US2012/038338, mailed Nov. 19, 2013; 11 pages.
LEDCONN Corp., exhibitor at Lightfair 2014 Jun. 1-5, 2014, "iFIT™ LED Light Panel", website copyright 2014; downloaded from http://ledconn.com/index.php/products/ifit-led-light-panel on Oct. 20, 2014; 5 pages.
The Aurora Group, exhibitor at Lightfair 2014 Jun. 1-5, 2014, VerseTile LED panels, website copyright 1999-2014, downloaded from http://gb.auroralighting.com/Products/Indoor-Luminaires/LED-Flat-Panels on Oct. 20, 2014, 4 pages.
Elumina Technology Inc., exhibitor at Lightfair 2014 Jun. 1-5, 2014, LED Panel Light G3, website copyright 2013, downloaded from http://www.eluminatech.com/pro/list2.php?cid=30&f=30&pa=30 on Oct. 20, 2014, 2 pages.
BrightView Technologies, exhibitor at Lightfair 2014 Jun. 1-5, 2014, Light Management/Angle Management products, website copyright 2014, downloaded from http://www.brightviewtechnologies.com/products/light-management/light-management/page.aspx?id=1129 on Oct. 20, 2014, 2 pages.
Pinnacle Architectural Lighting, exhibitor at Lightfair 2014 Jun. 1-5, 2014, brochure for Linero LED lighting product line, brochure downloaded from http://www.pinnacle-ltg.com/downloads/linero/Linero_Brochure.pdf on Oct. 20, 2014, 20 pages.
TCL LED USA, exhibitor at Lightfair 2014 Jun. 1-5, 2014, LED Panel Light, website copyright 2013, downloaded from http://tclledusa.com/products/led-panel-light/ on Oct. 20, 2014, 3 pages.
Cougar LED Lighting, exhibitor at Lightfair 2014 Jun. 1-5, 2014, 2014 Cougar LED lighting catalog, catalog downloaded from http://www.cougar-lighting.de/en/downloads-english/catalogues.html on Oct. 20, 2014, 20 pages.
European Patent Office, "Communication Pursuant to Article 94(3) EPC", Examination report for European patent application 12726949.6, mailed Feb. 2, 2015; 2 pages.
European Patent Office, Annex to the Communication Pursuant to Article 94(3) EPC , Examination report for European patent application 12726949.6, mailed Feb. 2, 2015; 5 pages.
Notice of the Reason for Refusal dated Mar. 15, 2016 corresponding to Japanese Patent Application No. 2014-511528, 7 pages.
English Translation of the Notice of the Reason for Refusal dated Mar. 15, 2016 corresponding to Japanese Patent Application No. 2014-511528, 6 pages.
Computer generated English translation of Registered Utility Model No. 3140783, transcribed from the Japan Platform of Patent Information, https://www.jplatpat.inpit.go.jp/web/all/top/BTmTopEnglishPage, on Apr. 22, 2016, 11 pages.
Computer generated English translation of Patent Application Laid-open No. 2011-138731, transcribed from the Japan Platform of Patent Information, https://www.jplatpat.inpit.go.jp/web/all/top/BTmTopEnglishPage, on Apr. 22, 2016, 32 pages.
Office Action dated Apr. 26, 2016 corresponding to U.S. Appl. No. 14/480,262, 18 pages.
Office Action dated May 4, 2016 corresponding to U.S. Appl. No. 14/554,919, 69 pages.
Power Integrations—DER-384—Oct. 2013 https://led-driver.power.com/sites/default/files.PDFFiles/der384.pdf?Adsource=Aden_EEW% 3felqTrack=true3futm_source=EEWeb&utm_medium=TechCommunity&utm_term=2014&utm_content=Content&utm_campaign=PowerIntegrations, 41 pages.
Advisory Action dated Jan. 25, 2016 corresponding to U.S. Appl. No. 14/554,919, 4 pages.
Interview Summary dated Apr. 5, 2016 corresponding to U.S. Appl. No. 14/554,919, 12 pages.
Office Action dated Apr. 7, 2016 corresponding to U.S. Appl. No. 14/246,823, 11 pages.
Office Action dated Jan. 22, 2016 corresponding to U.S. Appl. No. 14/248,197, 10 pages.
Office Action dated Mar. 9, 2016 corresponding to U.S. Appl. No. 14/254,822, 11 pages.
Notice of Allowance and Fee(s) Due dated Apr. 5, 2016 corresponding to U.S. Appl. No. 14/618,665, 14 pages.
Advisory Action dated Mar. 30, 2016 corresponding to U.S. Appl. No. 13/473,929, 4 pages.
Applicant-Initiated Interview Summary dated Mar. 18, 2016 corresponding to U.S. Appl. No. 14/480,772, 3 pages.
Office Action dated Dec. 18, 2015 corresponding to U.S. Appl. No. 14/480,772, 16 pages.
Examination Search Report dated Dec. 11, 2015 corresponding to Canadian Patent Application No. 2,835,213, 3 pages.
Office Action dated Sep. 21, 2015 corresponding to Chinese Patent Application No. 201280024002.3, 10 pages.

(56) References Cited

OTHER PUBLICATIONS

English Translation of Office Action dated Sep. 21, 2015 corresponding to Chinese Patent Application No. 201280024002.3, 8 pages.
Office Action dated Oct. 30, 2015 corresponding to Chinese Patent Application No. 201280023544.9, 6 pages.
English Translation of Office Action dated Oct. 30, 2015 corresponding to Chinese Patent Application No. 201280024002.3, 9 pages.
Canadian Intellectual Property Office, Examiners's Report under Subsection 30(2) of the Patent Rules, Examination Report for Canadian patent application 2,835,213, mailed Apr. 22, 2015, 4 pages.

* cited by examiner

NON-ROUND RETROFIT RECESSED LED LIGHTING FIXTURE

TECHNICAL FIELD

The present invention relates to a retrofit recessed LED lighting apparatus, and more particularly, to non-round recessed LED lighting fixtures suitable for retrofit installation.

BACKGROUND

Recessed LED downlight fixtures are typically installed above a ceiling. Typically, replacement or modifications to an installed lighting assembly require removal of the existing assembly or various components from the ceiling. An example of conventional recessed downlight fixture is disclosed in U.S. Pat. No. 8,348,477, "Light emitting diode recessed light fixture". This patent discloses a downlight fixture installed in a opening in a ceiling panel, a junction box mounted on the ceiling panel, and electric wires electrically connecting the LED downlight fixture with the junction box to supply electrical power to a LED driver of the LED downlight fixture.

Besides LED retrofit applications involving downlights that are mounted to a recessed junction box, another conventional type of recessed light or downlight application for retrofit LED light fixtures is sometimes called a recessed can light, referring to a light fixture including a can fixture that is installed into a hollow opening in a ceiling. When installed, a recessed can light appears to be light shining from a hole in the ceiling, concentrating the light in a downward direction as a broad floodlight or narrow spotlight. There are two main components to recessed can lights: the trim and the housing. The trim is the visible portion of the light fixture. It is the insert seen when looking up into the fixture, and also includes the thin lining around the edge of the light. In conventional can lights, the housing is the fixture itself that is installed inside the ceiling and contains the lamp holder. An exemplary recessed can light is disclosed in US Patent Application 20130100650 A1, Downlight LED Retrofit Kit.

The junction-box type recessed LED downlight fixture of U.S. Pat. No. 8,348,477, and the recessed can light of the US Patent Application 20130100650, are both round, i.e., they both have a circular cross section. Round light fixtures are virtually standard for both types of LED downlight retrofit light fixtures, as this is a natural form factor for installation either with recessed cans, which are round, or with recessed downlight junction boxes, which also often are round. A problem in retrofit installation of square, rectangular, or other non-round LED light form factors in recessed downlight applications is the difficulty of mounting the light in a desired orientation. In architectural recessed lighting installations including downlight cans or junction boxes, it is not normal practice to install the can or junction box with a view to providing a particular orientation of a recessed lighting fixture. This is to be expected, since conventional recessed lighting fixtures are generally round, and lighting fixtures for retrofit installation to replace such conventional recessed lighting fixtures also are generally round and hence do not require particular orientation. What is needed is non-round retrofit recessed LED down lighting fixtures, designed to facilitate retrofit installation of the non-round LED downlight fixtures in a desired orientation in an architectural recessed lighting installation.

SUMMARY

A light emitting diode (LED) light fixture for attachment and electrical coupling to a recessed electrical connection enclosure includes a mounting fixture and a source of electrical power. The light fixture includes a luminaire with a frame having a non-round form, and a substantially flat light emitting diode (LED) panel disposed within the frame. In an embodiment, the luminaire of the light fixture is rotatably joined to a mounting member at a rotary connector. The mounting member includes least one fastener for attachment of the mounting member to the mounting fixture of the recessed electrical connection enclosure. The luminaire may be rotated relative to the mounting member attached to the mounting fixture of the recessed electrical connection enclosure, to orient the non-round frame of the luminaire in a desired orientation.

In an embodiment, a light emitting diode (LED) light fixture for installation at a recessed electrical connection enclosure including a mounting fixture, comprises a luminaire, comprising a frame having a non-round form; and a substantially flat light emitting diode (LED) panel disposed within the frame having the non-round form; and an attachment assembly, comprising a mounting member; at least one fastener; and a rotary connector; wherein the attachment assembly is configured for attachment of the mounting member to the mounting fixture of the recessed electrical connection enclosure via the at least one fastener, and the luminaire is rotatably joined to the mounting member at the rotary connector to permit rotation of the luminaire relative to the attachment assembly.

In another embodiment, a light emitting diode (LED) light fixture, for use in installation at a recessed electrical connection enclosure including a mounting fixture, comprises a luminaire having a non-round shape; and a substantially flat light emitting diode (LED) panel disposed within the luminaire having the non-round shape; and an attachment assembly, comprising a mounting bar; a first fastener joined to the mounting bar at a first side of the mounting bar; and a second fastener joined to the mounting bar at a second side of the mounting bar; and a rotary connector located between the first fastener and the second fastener; wherein the attachment assembly is configured for attachment of the mounting bar to the mounting fixture of the recessed electrical connection enclosure via the at least one fastener, and the luminaire is rotatably joined to the mounting member at the rotary connector to permit rotation of the luminaire relative to the attachment assembly.

Additional features and advantages of an embodiment will be set forth in the description which follows, and in part will be apparent from the description. The objectives and other advantages of the invention will be realized and attained by the structure particularly pointed out in the exemplary embodiments in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

Non-limiting embodiments of the present disclosure are described by way of example with reference to the accompanying figures which are schematic and are not intended to be drawn to scale. Unless indicated as representing the background art, the figures represent aspects of the disclosure.

DETAILED DESCRIPTION

Figure 1:
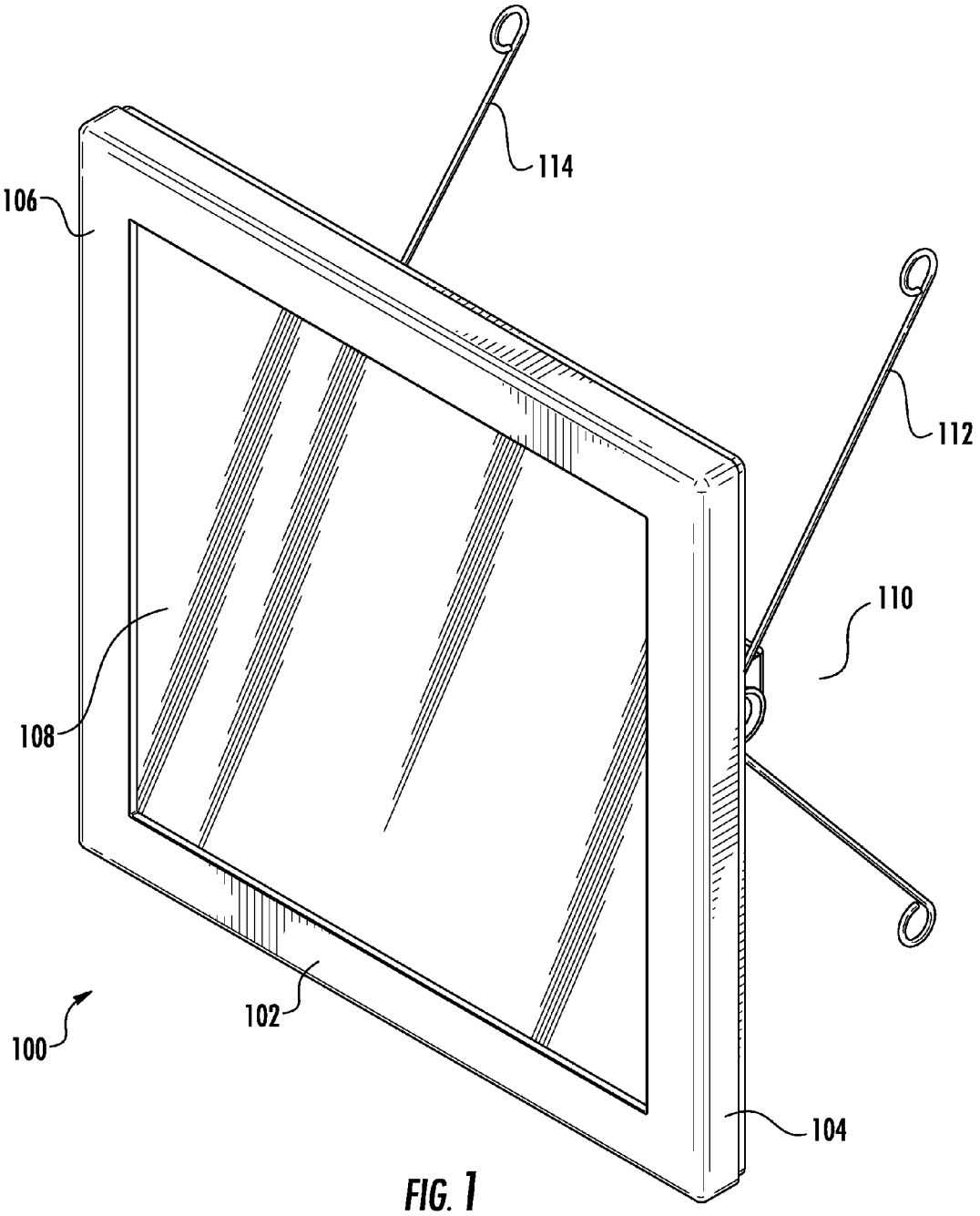
FIG. 1 illustrates a front perspective view of a non-round light emitting diode (LED) light fixture in accordance with an embodiment.
Figure 2:
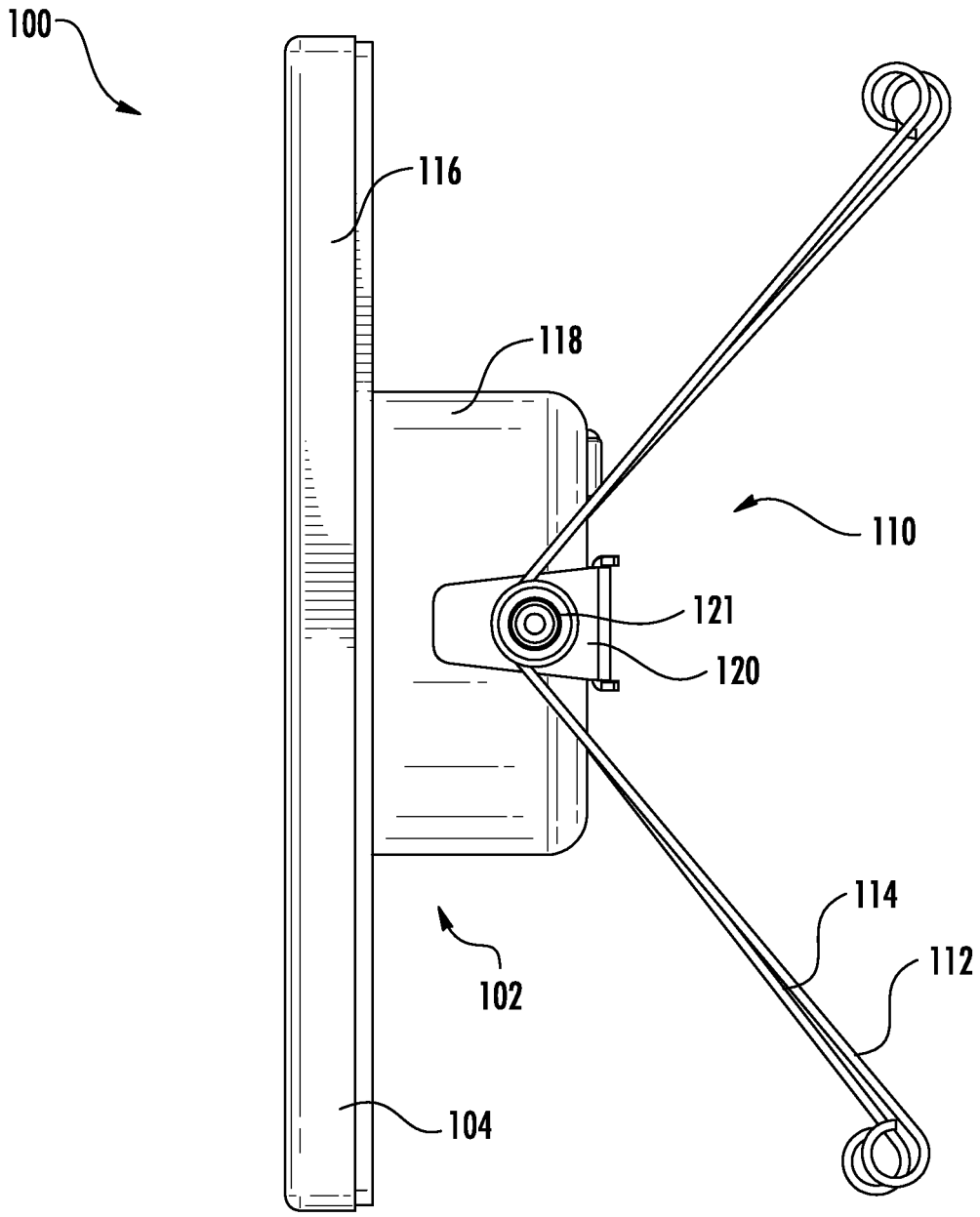
FIG. 2 illustrates a end view of a non-round light emitting diode (LED) light fixture in accordance with the embodiment of FIG. 1.

The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here. Furthermore, the various components and embodiments described herein may be combined to form additional embodiments not expressly described, without departing from the spirit or scope of the invention.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to one skilled in the relevant art and having possession of this disclosure, are to be considered within the scope of the invention.

FIGS. 1-5 illustrate a non-round LED light fixture in accordance with a first embodiment. The present non-round LED light fixtures are configured for installation with a recessed electrical connection enclosure. In an embodiment, such installations are used in architectural lighting such as architectural downlights. An architectural downlight installation may comprise a recessed electrical connection enclosure including a mounting fixture for attaching a downlight, and a source of electrical power, such as AC power. In a first downlight embodiment, the recessed electrical connection enclosure includes a recessed housing, sometimes called a "can" housing, mechanically attached and electrically coupled to an LED lighting fixture. In a second embodiment, the recessed electrical connection enclosure includes a recessed junction box, mechanically attached and electrically coupled to an LED lighting fixture. Whereas conventional down lighting installations based upon recessed electrical connection enclosures incorporate round lighting fixtures, the present LED lighting fixture of the present disclosure comprises a non-round LED light fixture. The non-round LED light fixture of the present disclosure also may be installed with other recessed electrical connection enclosure installations, such as recessed wall lighting installations.

As seen in FIG. 1, LED light fixture 100 includes a luminaire 102 and an attachment assembly 110, seen in part in this view. Luminaire 102 includes a frame 104. Light is emitted by a substantially flat light emitting diode (LED) panel 108 that is partially visible at a front surface of the luminaire 102. The frame 104 include a bezel portion 106 of the frame surrounding the visible portion of the substantially flat light emitting diode (LED) panel 108.

The term "substantially flat light emitting diode (LED) panel," as used in connection with the description of various embodiments, is meant to include LED panels having a thickness that is substantially less than the length and width of the panel. In addition, the term "substantially flat LED panel" is meant to include LED panels of slightly non-uniform thickness. The substantially flat light emitting diode (LED) panel may include various optical materials and configurations, such as configurations including light emitting diodes (LEDs) at one or more edge of an optically transmissive panel, and configurations including an array light emitting diodes (LEDs) at a face of a substantially flat panel.

The luminaire 102, which may include the frame 104 and the substantially flat LED panel 108, may have a variety of dimensions and non-round forms (also herein called shapes, and form factors), including, but not limited to, square, rectangular, other polygonal (e.g., pentagonal, hexagonal, octagonal), and oval and elliptical forms. As used in the present disclosure, "non-round" shapes or form factors of the LED light fixture 100 refer to non-circular shapes or form factors. In an embodiment, the frame 104 of luminaire 102 has a substantially square form, and the substantially flat LED panel 108 is visible through a substantially square aperture; wherein "aperture" indicates linear dimension(s) of a light emission area of the substantially flat LED panel 108. For example, the luminaire 102 can be square with a size of approximately eight inches by eight inches (8" by 8"). In another embodiment, the luminaire 102 can be square with a size of approximately six inches by six inches (6"∴6"). In another exemplary embodiment, the luminaire 102 can be rectangular a size of about six inches by twelve inches (6"×12").

In an embodiment, rotatable mounting member 120 is mounted to a cylindrical housing 118 at the rear surface of luminaire 102. The frame 104 may include a rectangular frame 116, and an integral cylindrical housing 118 protruding from the rear of rectangular frame 116. Alternatively, the cylindrical housing 118 and the rectangular frame may be separate structures that are joined during assembly of frame 104. The cylindrical housing 118 provides additional room for housing internal components of luminaire 102, such a power supply and driver circuitry. In an embodiment, the cylindrical housing 118 of luminaire 102 houses an internal power supply for converting AC power to DC power.

In an embodiment, the frame 104 is comprised of a metal, a metal alloy, or a composite material including a metal. For example, the frame may be comprised of ferrous metals, or non-ferrous metals such as aluminum, brass, bronze, copper, and stainless steel. The frame may include a surface treatment such as electroplating or powder coating. Surface treatments for improved durability, such as rust-proofing, may be applied to frame 104.

Attachment assembly 110 includes components of LED light fixture 100 for attachment of luminaire 102 to recessed electrical connection enclosure installations. In the first embodiment of FIGS. 1-5, attachment assembly 110 includes first torsion spring 112 and second torsion spring 114, mounted on a rotatable mounting member 120 at the rear surface of luminaire 102. As seen in the end view of FIG. 2, rotatable mounting member 120 supports a first torsion spring 112 at the near end, which may be secured by a nut 121, and a second torsion spring 114 at its far end. As described below, first torsion spring 112 and second torsion spring 114 comprise fasteners of attachment assembly 110, configured for attachment of the rotatable mounting member 120 to a mounting fixture of a recessed electrical connection enclosure.

Figure 3:
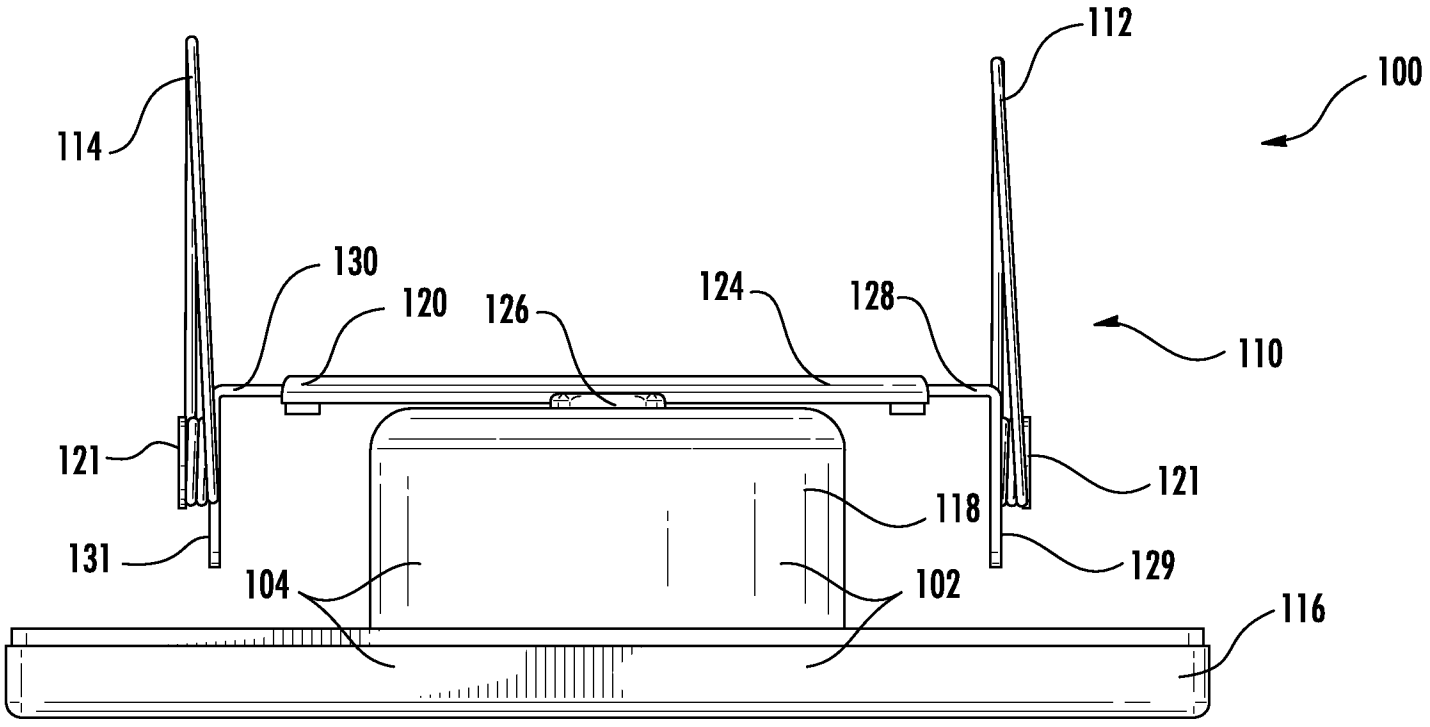
FIG. 3 illustrates a side view of a non-round light emitting diode (LED) light fixture in accordance with the embodiment of FIG. 1.

As seen is the side view in FIG. 3, the rotatable mounting member 120 of attachment assembly 110 includes a rotatable bar 124, which may be mounted substantially at a center point of the rotatable bar to the cylindrical housing 118 of light fixture 102. In an embodiment, rotatable bar 124 is mounted to cylindrical housing 118 via rotary connector 126. Rotary connector 126 is rotatably joined to rotatable bar and other structures of attachment assembly 110, permitting luminaire 102 to rotate relative to attachment assembly 110 during installation of the LED light fixture 100.

Figure 4:
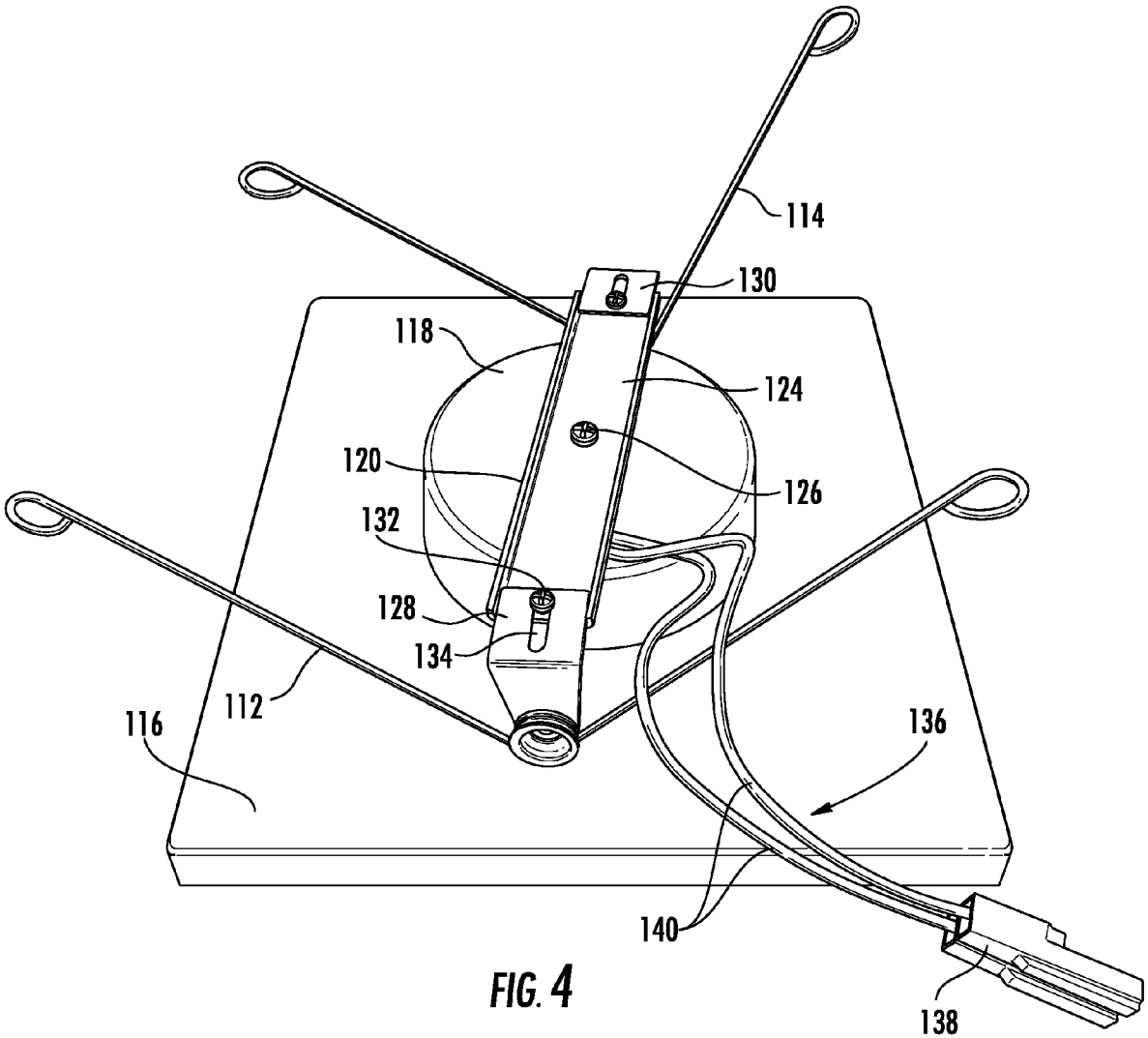
FIG. 4 illustrates a rear perspective view of a non-round light emitting diode (LED) light fixture in accordance with the embodiment of FIG. 1.

Other structures of attachment assembly 110 include first mounting arm 128 attached at one end of rotatable bar 124, and second mounting arm 130 attached at the other end of rotatable bar 124. As seen in FIGS. 3 and 4, first mounting arm 128 and second mounting arm 130 are substantially L-shaped members that each include an upper arm that extends from an end of rotatable bar 124, and a lower arm (129, 131) that extends downwardly from the upper arm. As seen in FIG. 4, the upper arm of first mounting arm 128 includes a slot 134 and screw 132, which fasten the first mounting arm to the rotatable bar 124 in a repositionable configuration. The upper arm of second mounting arm 130 is similarly configured. The first torsion spring 112 is secured to lower arm 129 by nut 121, and the repositionable fastening of the first mounting arm 128 supports the first torsion spring 112 at a repositionable location on the mounting bar 124. Likewise, the second torsion spring 114 is secured to lower arm 131, and the repositionable fastening of the second mounting arm 130 supports the second torsion spring 114 at a repositionable location on the mounting bar 124.

The LED light fixture 100 of FIG. 4 also includes connector assembly 136, including electrical wires 140 and electrical connector 138. In an embodiment in which the frame of luminaire 102 (e.g., cylindrical housing 118) houses power circuitry for converting AC power to DC power to drive the substantially flat light emitting diode (LED) panel 108, light fixture 100 does not need an external transformer for this purpose.

Figure 5:
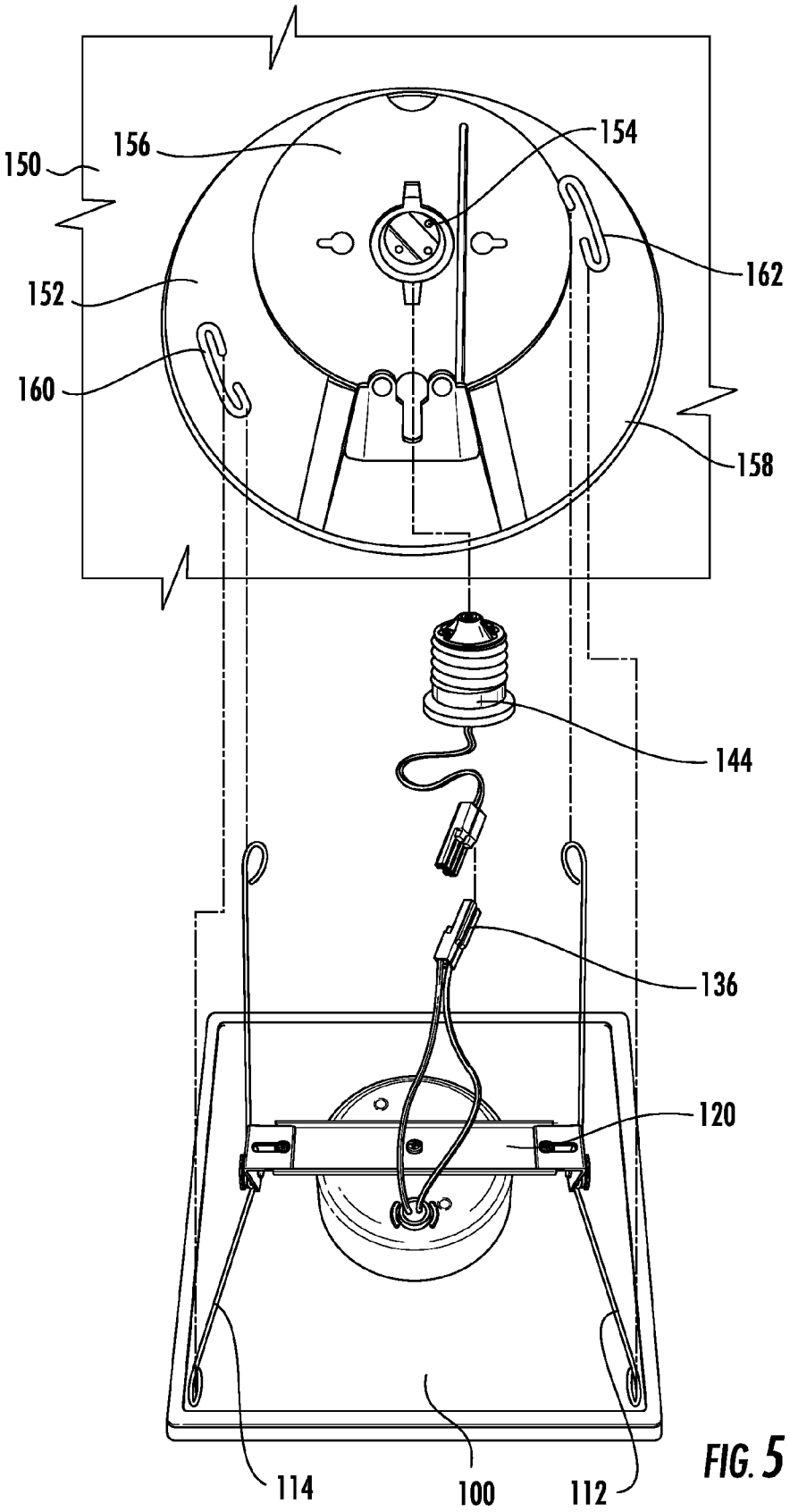
FIG. 5 illustrates a perspective view of a non-round light emitting diode (LED) light fixture in process of installation in a recessed housing downlight fixture in accordance with the embodiment of FIG. 1.

FIG. 5 is a perspective view of light fixture 100 during installation to a recessed downlight installation 150. Downlight installation 150 includes a recessed electrical connection enclosure 152 (also herein called recessed enclosure), which may have been previously installed with a different type of light fixture such as an incandescent light fixture. In this embodiment, recessed electrical connection enclosure 152 is the type of recessed enclosure sometimes called a "can" housing, and includes a source of electrical power, e.g., AC socket 154 housed in a socket plate 156 at the base of recessed enclosure 152. Recessed electrical connection enclosure 152 also includes a mounting fixture used for attaching a light fixture to the recessed electrical connection enclosure 152. In the embodiment of FIG. 5, the mounting fixture consists of clasps 160, 162 at opposing walls of the recessed enclosure 152. Clasps or other mounting fixtures may take various forms, herein consisting of "ears" that define attachment apertures or slots within the ears.

As a first step of installing LED light fixture 100 in the recessed downlight installation 150, an electrical adapter 144 (also called screw base adapter 144) is screwed into electrical socket 154, possibly after removing and then reinstalling the socket 154 and socket plate 156. Then, connector assembly 136 may be attached to electrical adapter 144. The attachment assembly 110 of light fixture is then attached to the mounting fixture, i.e., clasps 160, 162, of the recessed electrical connection enclosure 152.

In the embodiment of FIGS. 1-5, in which the attachment assembly 110 includes fasteners in the form of torsion springs 112 and 114, this attachment process involves pressing together the arms of each torsion spring 112, 114. With each of the torsion springs in this compressed configuration, the torsion spring arms are inserted in the slots or apertures defined by clasps 160, 162, then released. Once the torsion springs have been thus inserted, the user may press the light fixture 100 into the downlight installation 150 so that the frame 104 will rest against the ceiling and the cylindrical housing 118 will be inserted within recessed enclosure 152. Before the light fixture is fully pressed into place, the user can rotate the non-round luminaire 102 (i.e., rotation relative to the installed attachment assembly 110) to a desired orientation. The user may select an orientation of the non-round LED light fixture based upon various considerations including by way of example room layout, location and orientation of other fixtures or features of an architectural installation, ceiling grid configuration, etc.

Alternatively, the user may rotate and orient the luminaire 102 after LED light fixture 100 has been installed against the ceiling or other architectural installation, provided that there is adequate clearance to permit rotation. After rotating the LED light fixture 100 to a desired orientation, it may be desirable to further press in place or otherwise secure the LED light fixture to limit its freedom of rotation, so that the light fixture remains in the chosen orientation if and when it is subjected to shaking, vibration or other forces.

Figure 6:
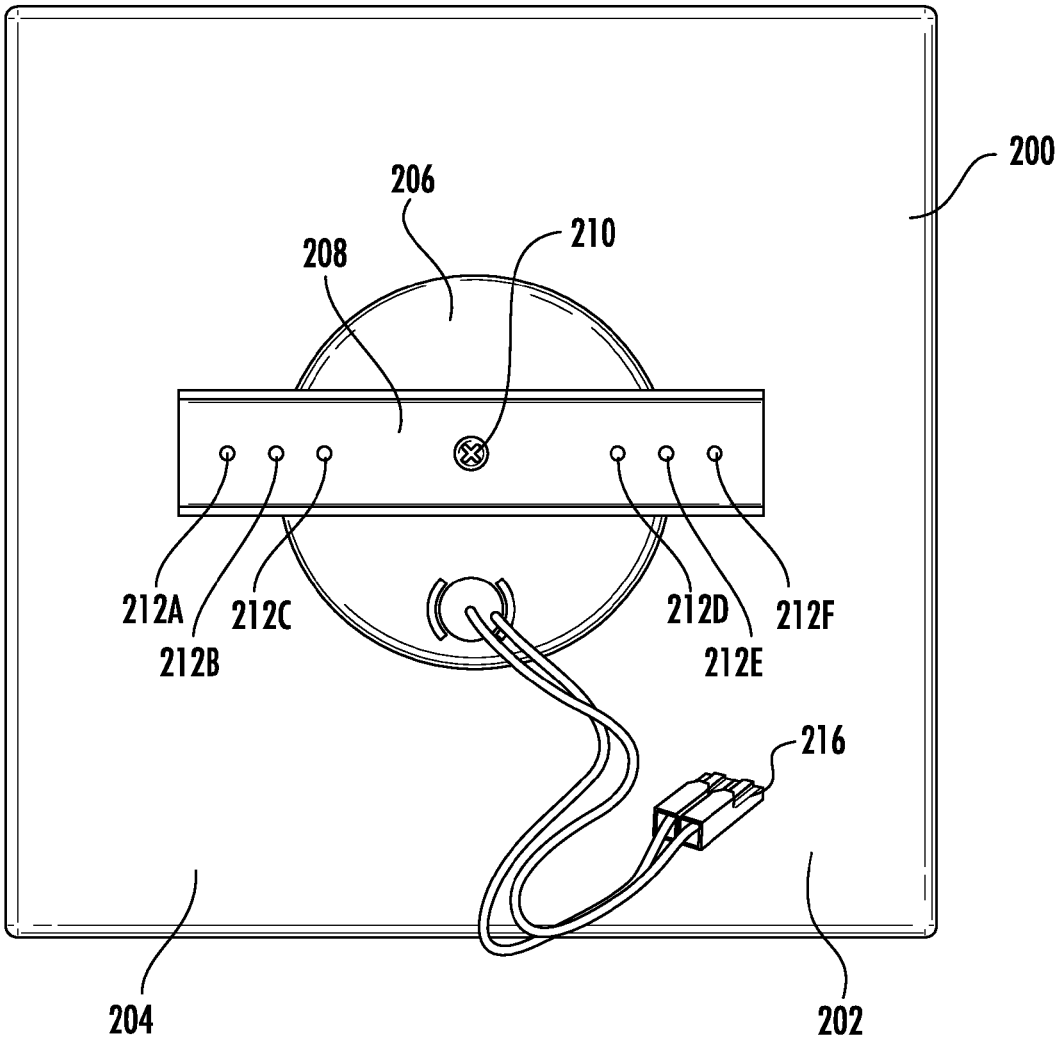
FIG. 6 illustrates a rear perspective view of a non-round light emitting diode (LED) light fixture in accordance with a second embodiment.
Figure 7:
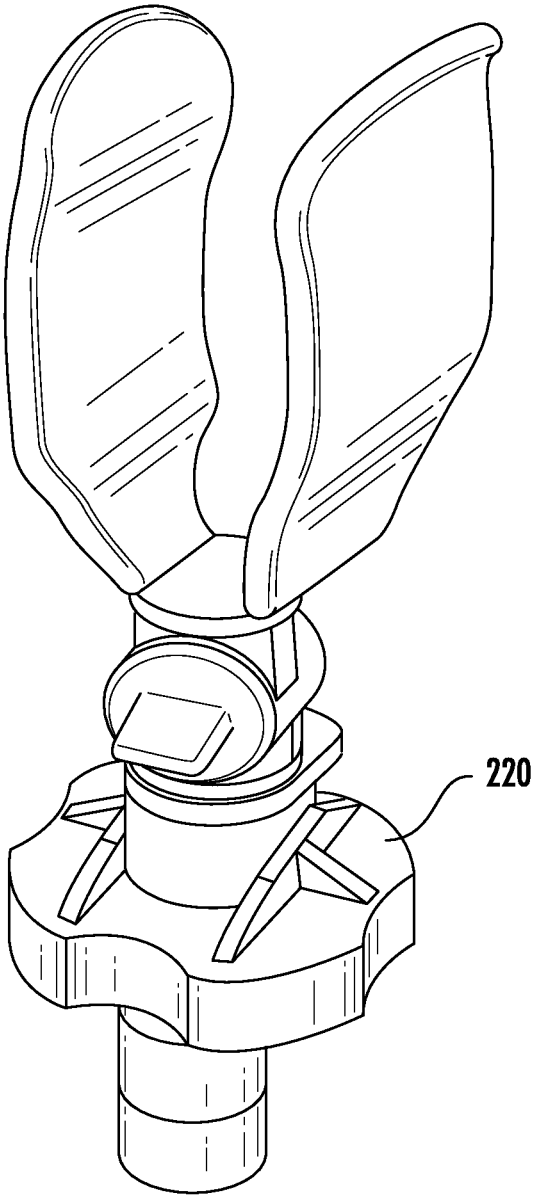
FIG. 7 illustrates a perspective view of a mounting clip for a non-round light emitting diode (LED) light fixture in accordance with the embodiment of FIG. 6.

Turning now to FIGS. 6 and 7, a further embodiment of non-round LED light fixture 200 (here seen from the rear) includes a rotatable bar 208 rotatably mounted to luminaire 202. The luminaire 202 includes a square frame 204, and may be generally similar to the luminaire 100 of FIGS. 1-5. Rotatable bar 208 is rotatably mounted to cylindrical housing 206 of luminaire 202 by a centrally located rotary connector 210. Rotatable bar 208 includes at one side of rotary connector a series of junction locations 212A, 212B, and 212C, and includes at the other side of rotary connector 210 a corresponding series of junction locations 212F, 212E, and 212D. In an embodiment, a pair of fasteners such as a two mounting clips 220 as shown in FIG. 7, may be mounted within selected junction locations, appropriate to the dimensions of the mounting fixture of a given recessed electrical connection enclosure. For example, fasteners 220 for attaching light fixture 200 to a relatively large mounting fixture of a recessed electrical connection enclosure may be joined to outer junction locations 212A, 212F, while fasteners 220 for attaching light fixture 200 to a relatively small mounting fixture of a recessed electrical connection enclosure may be joined to inner junction locations 212C, 212D.

Figure 9:
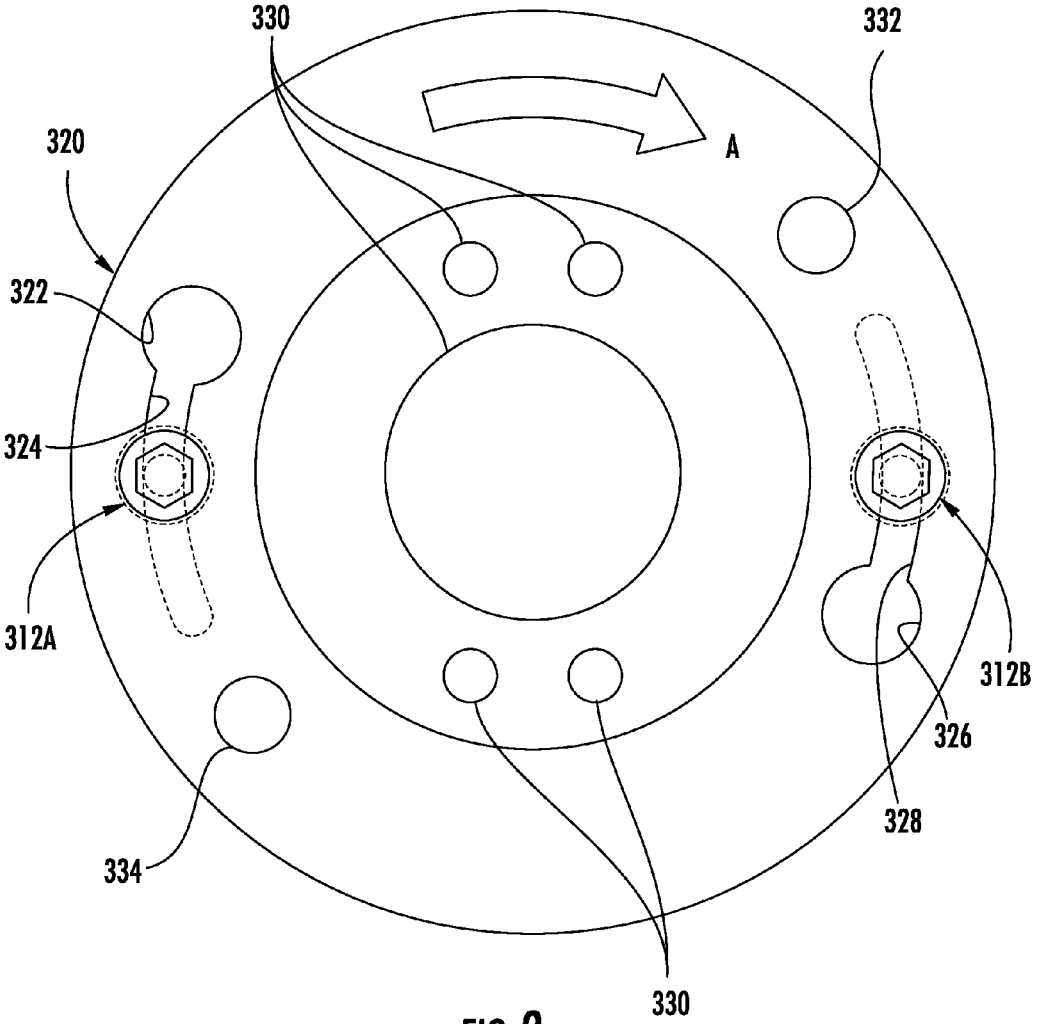
FIG. 9 illustrates a rear perspective view of a mounting bracket for junction box mounting of a non-round light emitting diode (LED) light fixture in accordance with a fourth embodiment.

In the mounting fixture embodiment as seen in FIG. 9, the rotatable bar 208 is configured to attach non-round LED light fixture 200 to apertures 332, 334 of a bracket 320 (also called a J-box bracket) for a junction-box (J-box) type recessed electrical connection enclosure (not shown). Bracket 320 also may include apertures 330 for other purposes, e.g. for screws to mount the bracket to the J-box, and for electrical connectors to the J-Box. Mounting clips 220 may be joined to appropriate junction locations 212A-212F depending on the size of the junction-box recessed electrical connection enclosure and bracket 320; e.g., with 6", 5" and 4" sizes. Once secured to the J-box bracket 320, the user can rotate the luminaire 202 at rotary connector 210 to a desired final orientation.

Figure 8:
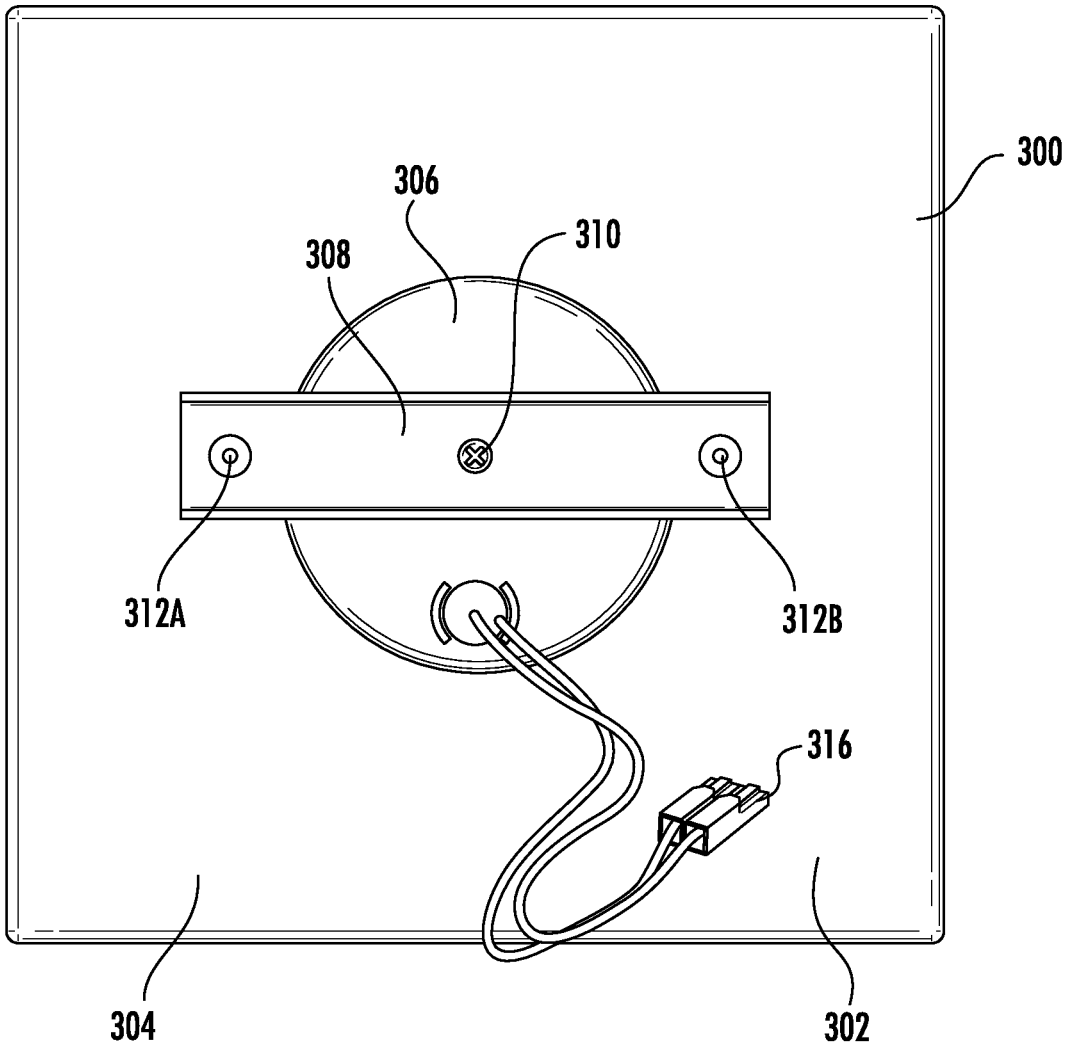
FIG. 8 illustrates a rear perspective view of a non-round light emitting diode (LED) light fixture in accordance with a third embodiment.

In the embodiment of FIGS. 8 and 9, a non-round light emitting diode (LED) light fixture incorporates a twist-and-lock mechanism to fasten its attachment assembly to a bracket of a junction box (J-box) recessed electrical connection enclosure. Bolt-head hardware on the attachment assembly mates with a twist-and-lock mechanism of the J-box bracket to attach and secure the light fixture to the bracket. FIG. 8 shows a rear perspective view of a non-round LED light fixture 300 including a rotatable bar 308, rotatably mounted by rotary connector 310 to cylindrical housing 306 of luminaire 302. The luminaire 302 includes a square frame 304, and may be generally similar to the luminaire 100 of FIGS. 1-5. Rotatable bar 308 includes bolt-heads 312A, 312B joined near the ends of the bar.

FIG. 9 shows a mounting bracket 320 for J-box mounting of a non-round light emitting diode (LED) light fixture. To mount the light fixture 300 to the J-box installation, the user inserts bolt heads 312A, 312B of the rotatable mounting bar 308 into keyways 322, 326 of J-box bracket 320. Upon rotating the rotatable mounting bar 308 in a clockwise direction (in the direction of the arrow A), the bolt heads 312A, 312B move into the locking slots 324, 328 and the light fixture is locked onto the J-box bracket 320. Accordingly, the light fixture 300 can be simply attached to the J-box bracket in a twist-and-lock fashion. Once secured to the J-box bracket, the user can rotate the luminaire 302 at rotary connector 310 to a desired final orientation.

Figure 10:
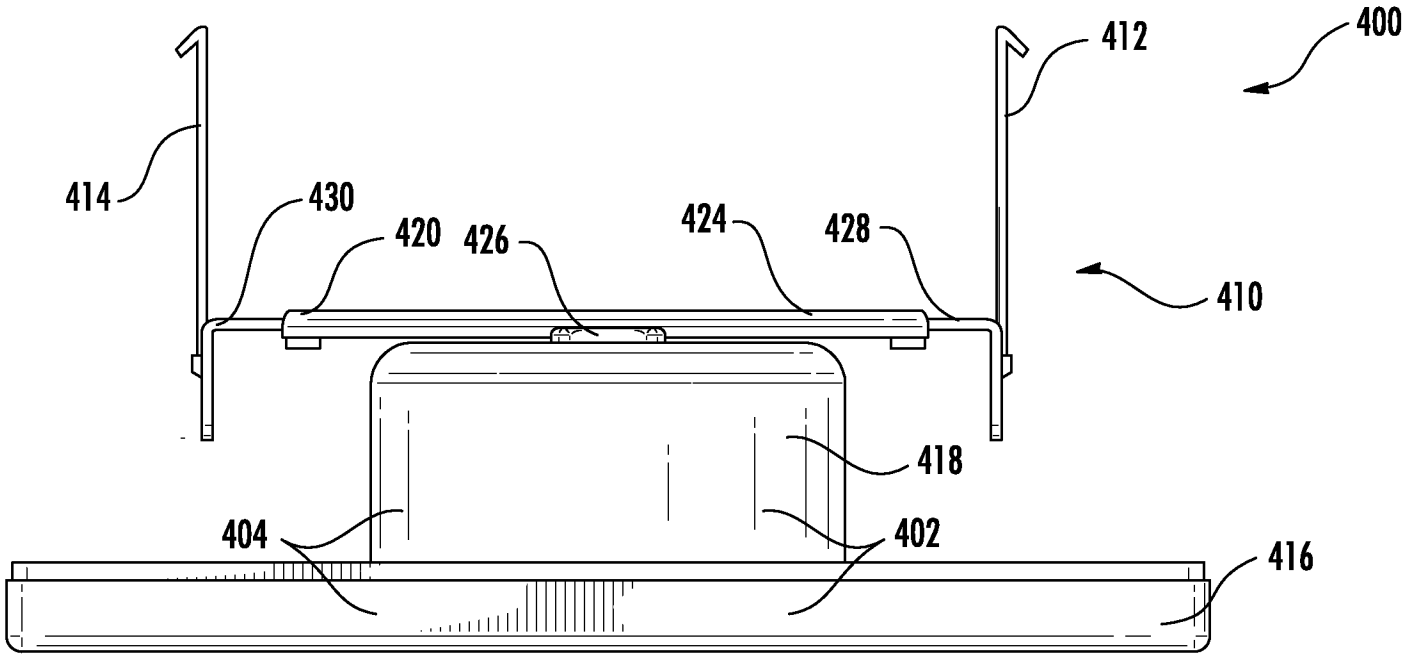
FIG. 10 illustrates a side perspective view of a non-round light emitting diode (LED) light fixture in accordance with a fifth embodiment.

FIG. 10 shows a further embodiment of fastener of a non-round light emitting diode (LED) light fixture 400 for attachment to the mounting fixture recessed electrical connection enclosure. The non-round light emitting diode (LED) light fixture 400 may be generally similar to the light emitting diode (LED) light fixture 100 of FIGS. 1-5, and the description of structure and installation of the light emitting diode (LED) light fixture 100 may apply to light emitting diode (LED) light fixture 400, subject to the following differences. In lieu of the torsion spring fasteners 112, 114 shown e.g., in FIG. 3, light emitting diode (LED) light fixture 400 incorporates tension clips 412, 414 as fasteners at the ends of rotatable mounting member 420. Rotatable mounting member 420 may include rotatable mounting bar, and first and second mounting arms 428, 430. In lieu of the recessed downlight installation 150 of FIG. 5, in which the mounting fixture includes clasps 160, 162 for engaging the torsion spring fasteners, the tension clips 412, 414 of non-round light emitting diode (LED) light fixture 400 may be adapted to be attached within a recessed housing downlight fixture (not shown) that is configured to receive and engage the tension clips, e.g., via a press-fit mechanism. Once the attachment assembly 410 is attached to the recessed housing downlight fixture, or during the attachment process, the user can rotate the luminaire 402 at rotary connector 426 to a desired final orientation.

While various aspects and embodiments have been disclosed, other aspects and embodiments are contemplated. The various aspects and embodiments disclosed are for purposes of illustration and are not intended to be limiting, with the true scope and spirit being indicated by the following claims.

The foregoing method descriptions and the interface configuration are provided merely as illustrative examples and are not intended to require or imply that the steps of the various embodiments must be performed in the order presented. As will be appreciated by one of skill in the art the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations can be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

The various illustrative logical blocks, modules, circuits, and algorithm steps described in connection with the embodiments disclosed here may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

What is claimed is:

1. A light emitting diode (LED) light fixture, for use in installation at a recessed electrical connection enclosure including a mounting fixture; the light emitting diode (LED) light fixture comprising:

a luminaire, comprising a frame having a non-round form; and a substantially flat light emitting diode (LED) panel disposed within the frame having the non-round form; and an attachment assembly, comprising a mounting member; at least one fastener; and a rotary connector;

wherein the attachment assembly is configured for attachment of the mounting member to the mounting fixture of the recessed electrical connection enclosure via the at least one fastener, and the luminaire is rotatably joined to the mounting member at the rotary connector to permit rotation of the luminaire relative to the attachment assembly.

2. The light emitting diode (LED) light fixture of claim 1, wherein the mounting member comprises a mounting bar, and wherein the rotary connector is located substantially at a center point of the mounting bar.

3. The light emitting diode (LED) light fixture of claim 2, wherein the at least one fastener has an repositionable location on the mounting bar.

4. The light emitting diode (LED) light fixture of claim 2, wherein the at least one fastener is joined to a repositionable support member at an end of the mounting bar.

5. The light emitting diode (LED) light fixture of claim 2, wherein mounting bar has an axis, the mounting bar has a plurality of junction locations along the axis, and the at least one fastener is joined to the mounting bar at one of the plurality of junction locations along the axis of the mounting bar.

6. The light emitting diode (LED) light fixture of claim 1, wherein the at least one fastener comprises a first fastener at one side of the mounting member, and a second fastener at an opposite side of the mounting member, with the rotary connector between the first fastener and the second fastener.

7. The light emitting diode (LED) light fixture of claim 1, wherein the at least one fastener comprises a first tension clip at one side of the mounting member, and a second tension clip at an opposite side of the mounting member with the rotary connector between the first tension clip and the second tension clip.

8. The light emitting diode (LED) light fixture of claim 1, wherein the at least one fastener comprises a first torsion spring at one side of the mounting member, and a second torsion spring at an opposite side of the mounting member with the rotary connector between the first torsion spring and the second torsion spring.

9. The light emitting diode (LED) light fixture of claim 1, wherein the recessed electrical connection enclosure comprises a junction box, wherein the mounting fixture comprises a mounting bracket of the junction box, and wherein the at least one fastener comprises a mounting clip for attachment to a fastening mechanism of the mounting bracket.

10. The light emitting diode (LED) light fixture of claim 1, wherein the recessed electrical connection enclosure comprises a junction box, wherein the mounting fixture comprises a mounting bracket of the junction box, and wherein the at least one fastener is attached to a fastening mechanism of the mounting bracket via twist-and-lock attachment during rotation of the mounting member at the rotary connector.

11. The light emitting diode (LED) light fixture of claim 1, wherein the recessed electrical connection enclosure includes a source of electrical power, further comprising an electrical adapter for electrical coupling the luminaire to the source of electrical power of the recessed electrical connection enclosure.

12. The light emitting diode (LED) light fixture of claim 1, wherein the substantially flat light emitting diode (LED) panel of the luminaire includes an array of light emitting diodes (LEDs), the frame of the luminaire includes a rear housing containing power circuitry for converting AC power to DC power to drive the array of light emitting diodes (LEDs), and wherein the rear housing of the luminaire is rotatably joined to the mounting member at the rotary connector.

13. The light emitting diode (LED) light fixture of claim 1, wherein the frame of the luminaire has a square form.

14. A light emitting diode (LED) light fixture, for use in installation at a recessed electrical connection enclosure including a mounting fixture; the light emitting diode (LED) light fixture comprising:

a luminaire having a non-round shape; and a substantially flat light emitting diode (LED) panel disposed within the luminaire having the non-round shape; and an attachment assembly, comprising a mounting bar; a first fastener joined to the mounting bar at a first side of the mounting bar; and a second fastener joined to the mounting bar at a second side of the mounting bar; and a rotary connector located between the first fastener and the second fastener;

wherein the attachment assembly is configured for attachment of the mounting bar to the mounting fixture of the recessed electrical connection enclosure via the at least one fastener, and the luminaire is rotatably joined to the mounting member at the rotary connector to permit rotation of the luminaire relative to the attachment assembly.

15. The light emitting diode (LED) light fixture of claim 14, wherein the rotary connector is located at a substantially central location of the mounting bar.

16. The light emitting diode (LED) light fixture of claim 14, wherein the first fastener is joined to a repositionable support member at a first end of the mounting bar, and the second fastener is joined to a repositionable support member at a second end of the mounting bar.

17. The light emitting diode (LED) light fixture of claim 14, wherein the first fastener comprises a first torsion spring, and a second fastener comprises a second torsion spring.

18. The light emitting diode (LED) light fixture of claim 14, wherein mounting bar has an axis, the mounting bar has a plurality of first junction locations along the axis at the first side of the mounting bar and has a plurality of second junction locations along the axis at the second side of the mounting bar, and wherein the first fastener is joined to the mounting bar at one of the plurality of first junction locations, and the second fastener is joined to the mounting bar at one of the plurality of second junction locations.

19. The light emitting diode (LED) light fixture of claim 14, wherein the recessed electrical connection enclosure comprises a junction box, wherein the mounting fixture comprises a mounting bracket of the junction box, and wherein the first fastener and the second fastener comprise mounting clips for attachment to a fastening mechanism of the mounting bracket.

20. The light emitting diode (LED) light fixture of claim 14, wherein the luminaire has a square shape.

* * * * *